US010046574B2

(12) United States Patent
Nitta

(10) Patent No.: US 10,046,574 B2
(45) Date of Patent: Aug. 14, 2018

(54) ELASTIC ROLLER

(71) Applicant: SATO HOLDINGS KABUSHIKI KAISHA, Tokyo (JP)

(72) Inventor: Haruhiko Nitta, Tokyo (JP)

(73) Assignee: SATO HOLDINGS KABUSHIKI KAISHA (JP)

( * ) Notice: Subject to any disclaimer, the term of this patent is extended or adjusted under 35 U.S.C. 154(b) by 348 days.

(21) Appl. No.: 14/916,382

(22) PCT Filed: May 30, 2014

(86) PCT No.: PCT/JP2014/064521
§ 371 (c)(1),
(2) Date: Mar. 3, 2016

(87) PCT Pub. No.: WO2015/052954
PCT Pub. Date: Apr. 16, 2015

(65) Prior Publication Data

US 2016/0200473 A1 Jul. 14, 2016

(30) Foreign Application Priority Data

Oct. 9, 2013 (JP) ..... 2013-211535

(51) Int. Cl.
*B41J 11/04* (2006.01)
*B65H 20/02* (2006.01)
(Continued)

(52) U.S. Cl.
CPC ..... *B41J 11/04* (2013.01); *B65C 9/1807* (2013.01); *B65H 20/02* (2013.01); *B65H 27/00* (2013.01);
(Continued)

(58) Field of Classification Search
CPC ..... B65H 2404/1312; B65H 2404/13171
(Continued)

(56) References Cited

U.S. PATENT DOCUMENTS 3,999,038 A * 12/1976 Sikes, Jr. ..... G03G 15/2053 100/176
4,089,378 A * 5/1978 Suzuki ..... B65H 27/00 169/54
(Continued)

FOREIGN PATENT DOCUMENTS

CN 1281756 A 1/2001
CN 201102361 Y 8/2008
(Continued)

OTHER PUBLICATIONS

Extended European Search Report and European Search Opinion dated Dec. 8, 2017 in corresponding European Patent Application No. EP 14 85 3115 (total 8 pages).
(Continued)

*Primary Examiner* — Jason L Vaughan
(74) *Attorney, Agent, or Firm* — Ostrolenk Faber LLP

(57) ABSTRACT

One embodiment of this invention is an elastic roller including: a roller shaft; and an elastic material member surrounding the roller shaft. The elastic material member may include: an inner layer elastic material member disposed on an outer periphery of the roller shaft, a coating layer disposed on an outer periphery of the inner layer elastic material member, a first side end part circumferential surface having a first side end part, and a second side end part circumferential surface having a second side end part. The coating layer is formed from a silicone resin having a hardness of 20 degrees or less based on a spring type hardness tester Asker C in accordance with SRIS 0101. The second side end part circumferential surface having an elastic roller diameter that gradually decreases towards the second side end part opposite to the first side end part.

33 Claims, 9 Drawing Sheets

(51) Int. Cl.
*B65C 9/18* (2006.01)
*B65H 27/00* (2006.01)

(52) U.S. Cl.
CPC ..... *B65H 2404/1312* (2013.01); *B65H 2404/1313* (2013.01); *B65H 2801/75* (2013.01)

(58) Field of Classification Search
USPC ..... 492/27, 47, 53, 56
See application file for complete search history.

(56) References Cited

U.S. PATENT DOCUMENTS 4,107,830 A * 8/1978 Thomson ..... A21C 3/021 492/14
4,378,737 A * 4/1983 Kirkpatrick ..... B26D 7/20 101/415.1
4,583,637 A * 4/1986 Ferguson ..... B65G 13/08 198/787
4,887,708 A * 12/1989 Brown ..... B65G 15/02 198/831
4,908,898 A * 3/1990 Kubo ..... A47L 11/085 15/230
5,319,430 A 6/1994 DeBolt et al.
5,728,252 A * 3/1998 Kniazzeh ..... B32B 37/0053 100/176
5,779,370 A 7/1998 Schroeder et al.
5,823,464 A 10/1998 Bohn et al.
6,402,673 B1 6/2002 Cyzycki et al.
6,944,419 B2 * 9/2005 Kawamoto ..... G03G 15/2025 399/327
7,299,909 B1 * 11/2007 Houghton ..... B65G 39/07 193/35 R
7,686,752 B2 * 3/2010 Dua ..... A21C 3/021 492/14
2004/0082451 A1 * 4/2004 Miyamori ..... G03G 15/0808 492/27
2004/0154146 A1 * 8/2004 Pruitt, Jr. ..... B65H 23/0251 26/99
2007/0012549 A1 1/2007 Kanaris
2007/0111873 A1 * 5/2007 Ito ..... G03G 15/6511 492/56
2011/0111127 A1 5/2011 Kanaris
2011/0211034 A1 9/2011 Katayama
2013/0050377 A1 2/2013 Inoue
2015/0203316 A1 7/2015 Nitta
2017/0183184 A1 6/2017 Nitta

FOREIGN PATENT DOCUMENTS

CN 201456388 U 5/2010
CN 201873737 U 6/2011
CN 202174798 U 3/2012
CN 102950917 A 3/2013
CN 202837820 U 3/2013
CN 202862775 U 4/2013
DE 867 517 C 2/1953
EP 0 808 789 A1 11/1997
EP 2 910 506 A1 8/2015
GB 926 085 A 5/1963
JP S60-130648 7/1985
JP H01-237780 9/1989
JP H06-001510 1/1994
JP 2000-505012 4/2000
JP 2002-116608 4/2002
JP 2003-195463 A 7/2003
JP 2009-286616 12/2009
JP 2011-031426 2/2011
JP 2011-164178 8/2011
JP 2013-049146 3/2013
WO WO 2014/061729 A1 4/2014

OTHER PUBLICATIONS

Office Action with Search Report dated Nov. 10, 2016 in corresponding Chinese Patent Application No. 201480049270.X (total 7 pages).
International Search Report dated Jul. 22, 2014 issued in corresponding International patent application No. PCT/JP2014/064521.

* cited by examiner

ELASTIC ROLLER

CROSS REFERENCE TO RELATED APPLICATIONS

The present application is a 35 U.S.C. § 371 National Phase conversion of PCT/JP2014/064521, filed May 30, 2014, which claim benefit of Japanese Application No. 2013-211535, filed Oct. 9, 2013, the disclosure of which is incorporated herein by reference. The PCT International Application was published in the Japanese language.

TECHNICAL FIELD

The present disclosure relates to an elastic roller. Specifically, it relates to a roller such as a platen roller or a nip roller that feeds a belt-shaped member such as a linerless label or a typical label with a liner. More specifically, it relates to an elastic roller that is able to prevent an adhesive agent layer or an adhesive from readily attaching to a linerless label or the like during feeding of the linerless label or the like, thereby preventing the linerless label from becoming wound up.

BACKGROUND ART

Conventionally, a linerless label has been developed that lacks a release paper (i.e., a liner) temporarily attached to a back surface side of an adhesive agent layer of a label. Accordingly, a linerless label is thought to be desirable as a resource-saving material because a liner does not need to be disposed of after usage thereof.

FIG. 13 shows a perspective view of one embodiment of a conventional linerless label 1 wound into a rolled shape. The linerless label 1, as partially indicated in an enlarged cross-sectional view in FIG. 13, includes a label substrate 2; an adhesive agent layer 3 of a back surface side; a thermosensitive color developing agent layer 4 of a front surface side; and a transparent release agent layer 5 of an upper layer side.

A position detection mark 6 is pre-printed on the label substrate 2 of the back surface side. In addition, fixed information (not shown) such as a design may be pre-printed on a front surface side of the label substrate 2 where necessary, in addition to a label user mark or name.

The linerless label 1 may be provided as a single leaf label piece 1A by cutting at a pre-calculated pitch on an intended cutting line 7.

FIG. 14 shows a schematic side view of a thermal printer 8 into which a linerless label 1 is loaded for printing variable information such as merchandise information such as a price or a barcode of merchandise or administrative information relating to a product or a service, where appropriate. The thermal printer 8 includes a supplier 9 of the linerless label 1; a guide member 10; a detector 11; a printing part 12; and a cutter 13.

The supplier 9 holds the linerless label 1 into a rolled shape, and the supplier 9 may feed out the linerless label 1 into a belt shape in a direction of the guide member 10, the detector 11, the printing part 12 or the cutter 13.

The guide member 10 includes a guide roller 14. The guide member 10 is able to guide the fed out linerless label 1 in a direction of the detector 11 or the printing part 12.

The detector 11 includes a location detection sensor 15. The detector 11 may detect a relative location of the linerless label 1 (label piece 1A) with respect to the printing part 12, by detecting the position detection mark 6 on the back surface side of the linerless label 1.

The printing part 12 includes a thermal head 16 and a platen roller 17 (elastic roller). The linerless label 1 is sandwiched between the thermal head 16 and the platen roller 17 via a predetermined printing pressure, the platen roller 17 is rotatably driven at a constant speed, and a thermosensitive color developing agent layer 4 develops color by a supply of printing data to a thermal head 16. Accordingly, predetermined variable information may be printed onto the linerless label 1 (label piece 1A).

The cutter 13 includes a fixed blade 18 and a movable blade 19. A printed linerless label 1 that has been fed between the fixed blade 18 and the movable blade 19 is cut at the intended cutting line 7 according to a preset pitch, and a label piece 1A is issued and ejected.

A roller composed of an elastic body such as a rubber material may be used in the platen roller 17 for feeding and printing the linerless label 1 in the abovementioned construction of the thermal printer 8. In order to prevent attachment by the adhesive agent of the adhesive agent layer 3, a platen roller 17 is formed that is composed of an adhesive agent made of silicone rubber material that prevents the attachment of the adhesive agent, or a silicone oil or the like is applied onto an outer peripheral surface of the platen roller 17.

However, it is difficult to completely prevent attachment of the adhesive agent during a long period of usage. The linerless label 1 that passes through the platen roller 17 may become attached to the platen roller 17 and rolled up (see, imaginary line in FIG. 14). Accordingly, the label can become stuck, which may interfere with normal feeding of label 1, printing, and the issuance of the label piece 1A.

In addition, in a case where printing and issuance ceases with the linerless label 1 sandwiched between the thermal head 16 and the platen roller 17, the linerless label 1 does not readily peel away from the platen roller 17, and thus the linerless label 1 may be easily rolled up (similar to that mentioned above).

Thus, typical maintenance such as an operation that cleans an outer peripheral surface of the platen roller 17 or an operation that exchanges the platen roller 17, or the like, must be repeated. Accordingly, there has been a need for the platen roller 17 (elastic roller) allowing stable feeding and printing over an extended period of time.

Moreover, in addition to the platen roller 17, there has also been a need for an elastic roller for a label superior in an anti-stick property or a release property, even as a roller for simple guidance of linerless label 1 such as the guide roller 14, or a nip roller (not shown in the figures) comprising a pair of rollers that are rotatably driven to feed the linerless label 1 or a roller, where appropriate for a construction of a printer.

Further, there has also been a need for an elastic roller for a label that can stably feed a loaded linerless label 1 or loaded typical label with a liner.

While attempts have been made to form a groove or the like on an outer surface of the platen roller 17 in order to avoid an attachment phenomenon resulting from the adhesive agent layer 3 by decreasing a contact surface area between the linerless label 1 (the adhesive agent layer 3) and the platen roller 17, the contact surface area between the back surface of the liner of the label and the platen roller 17 is insufficient, and thus unable to exert the required frictional force (gripping force) between the liner and the platen roller 17 at a time of feeding and printing of a label with a liner. Accordingly, a problem arises that a stable feeding or a printing action cannot be expected due to deterioration in a feeding function such as slippage of a label.

In addition, a groove or the like that is formed on the platen roller 17 may also be easily worn down.

Similar to the abovementioned linerless label 1, the abovementioned various problems may occur even in a case where feeding or guiding a belt-shaped member of a paper or a film base including an adhesive agent or layer a bonding agent layer on the back surface side, and thus there is a need for an elastic roller superior in an anti-stick property or a release property.

It has been proposed to cover an outer layer of an inner layer elastic material member with a silicone resin having specified hardness in order to solve various problems mentioned above.

In other words, providing a coating layer composed of a silicone resin having low hardness (spring type hardness tester Asker C in accordance with SRIS 0101, hereinafter referred to as "C hardness"), allows the silicone resin to have both a non-stick property or a release property with respect to the adhesive agent layer and the frictional force (gripping force) and anti-wear property necessary with respect to the belt-shaped member as a result of a gelated resin having low hardness (C hardness of 20° C. or lower).

Accordingly, a belt-shaped member such as the linerless label and the typical label with a liner may be stably fed and guided.

With respect to the thermal printer 8, while models such as a two-inch model, a four-inch model, a six-inch model, or the like, have been designed in accordance with the width of the belt-shaped member to be printed thereon and issued, printing and issuing may be accomplished by replacing a plurality of belt-shaped members (e.g., linerless label 1) having a different width using one thermal printer 8.

In the thermal printer 8, while the elastic roller (platen roller 17) is assembled in accordance with the belt-shaped member having the widest design. In a case where a one-inch wide narrow-width linerless label 1 is loaded in the six-inch model thermal printer 8, approximately five inches are left by deducting one-inch width of the linerless label 1 from a six-inch width, and the platen roller 17 and the thermal head 16 are brought into contact in the five inches width. The platen roller 17 has sufficient gripping force to feed the belt-shaped member. Thus, in a case where the contact width of the platen roller 17 and the thermal head 16 is broadened, the load caused by friction is increased and accurate feeding of a belt shaped member becomes difficult.

Further, it is known that the linerless label 1 is guided (i.e., feeding-to-one-side method) so as to be directed to a single-sided direction of the platen roller 17 of the thermal printer 8, and fed, as per a guidance system for the linerless label 1 in the thermal printer 8. Even in the thermal printer 8 of the above feeding-to-one-side method, printing and issuing may be accomplished by replacing a plurality of belt-shaped members (e.g., linerless label 1) having a different width. Similarly to the abovementioned case, in a case where the platen roller 17 and the thermal head 16 are in direct contact at a part where the platen roller 17 is exposed with respect to the linerless label 1, the load caused by friction is increased and accurate feeding of a belt shaped member becomes difficult.

RELATED ART

Patent Literature

Patent Literature 1: JP-A 2011-031426.

SUMMARY OF THE INVENTION

Problems to be Solved by the Invention

In view of the abovementioned problems, the present disclosure serves to provide an elastic roller such as a platen roller that is superior in an anti-stick property or a release property.

Further, the present disclosure serves to provide an elastic roller, such that an adhesive agent layer of a belt-shaped member such as a linerless label does not attach to a surface thereof.

Moreover, the present disclosure also serves to provide an elastic roller that is capable of stably feeding and guiding a belt-shaped member or a typical label with a liner, as well as a linerless label.

In addition, the present disclosure also serves to provide an elastic roller capable of stably feeding and guiding a belt-shaped member such as a linerless label and a typical label with a liner, or the like, by exerting a release property and a frictional force (gripping force).

Further, the present disclosure also serves to provide an elastic roller that is capable of stably feeding and guiding belt-shaped members such as a linerless label and a typical label with a liner, or the like, even in a case where the belt-shaped members having a different width, i.e., a belt-shaped member having a narrow width are loaded into the elastic roller in feeding-to-one-side method.

Means for Solving the Problems

In view of the above, with respect to an elastic roller such as a platen roller, the inventor focused on coating an outer layer of an inner layer elastic material member with silicon resin having a specified hardness, in other words, on forming a coating layer of a silicon resin having a low hardness (namely, hardness of 20 degrees or less based on a spring type hardness tester Asker C in accordance with SRIS 0101; referred to as "C hardness" hereinafter), and the inventor also focused on forming the elastic roller of "substantially asymmetrically cylinder shape", in which the elastic roller diameter gradually decreases by forming a sloping circumferential surface (a second side end part direction sloping circumferential surface) on the elastic roller. Accordingly, the elastic roller according to the present disclosure is an elastic roller for feeding a belt-shaped member, the elastic roller including: a roller shaft; and an elastic material member surrounding the roller shaft, the elastic material member configured to feed the belt-shaped member by making contact with the belt-shaped member, the elastic material member including: an inner layer elastic material member disposed on an outer periphery of the roller shaft, a coating layer disposed on an outer periphery of the inner layer elastic material member, the coating layer configured to make contact with the belt-shaped member, and the coating layer being formed from a silicone resin having a hardness of 20 degrees or less based on a spring type hardness tester Asker C in accordance with SRIS 0101, a first side end part circumferential surface having a first side end part, and a second side end part circumferential surface having a second side end part, the second side end part circumferential surface having an elastic roller diameter that gradually decreases towards the second side end part opposite to the first side end part in an axial direction of the roller shaft.

The second side end part circumferential surface may be formed such that a left-to-right shape of the elastic roller is asymmetrical with respect to a center part of the elastic material member in the axial direction of the roller shaft.

The second side end part circumferential surface may be formed such that a sloping circumferential surface starting part is a region in the axial direction of the elastic material member.

The elastic roller may include a first side end part circumferential surface having the elastic roller diameter that gradually decreases towards the first side end part in the axial direction of the roller shaft.

The elastic roller diameter of the elastic roller may have a maximum diameter in a maximum diameter part between the center part of the elastic material member and the first side end part in the axial direction of the roller shaft.

The elastic roller diameter of the elastic roller may continuously and gradually decrease from the maximum diameter part to the first side end part in the axial direction of the roller shaft.

The elastic roller diameter of the elastic roller may continuously and gradually decrease from the maximum diameter part to the second side end part in the axial direction of the roller shaft.

The elastic roller diameter of the elastic roller may be identical to the maximum diameter from the maximum diameter part to the first side end part in the axial direction of the roller shaft.

The elastic roller diameter of the elastic roller may gradually decrease step-wise from the maximum diameter part to the first side end part in the axial direction of the roller shaft.

The elastic roller diameter of the elastic roller may gradually decrease step-wise from the maximum diameter part to the second side end part in the axial direction of the roller shaft.

The elastic roller diameter of the elastic roller may have a minimum diameter on the second side end part in the axial direction of the roller shaft.

The coating layer may have a thickness of 10 to 100 μm.

The coating layer may have a uniform coating thickness in a plane perpendicular to the axial direction of the roller shaft.

The coating layer may have a maximum thickness at the maximum diameter part.

A difference in the elastic roller diameter of the elastic roller between the maximum diameter and a minimum diameter on the second side end part may be 10 to 180 μm.

A maximum diameter location mark for indicating the maximum diameter part may be disposed on the elastic material member.

An area of the maximum diameter part may be partially flat.

The silicone resin may have a thermosetting property.

The inner layer elastic material member may be formed from a thermoplastic material or a thermosetting elastomeric material.

The inner layer elastic material member may have a rubber hardness of 30 to 80 degrees according to a Durometer Hardness Testing Method Type A defined in JIS K6253.

The inner layer elastic material member may be configured with a plurality of inner layer grooves in a circumferential direction thereof.

The coating layer may be configured with a plurality of coating layer grooves in a circumferential direction thereof.

The inner layer elastic material member may be configured with a flat inner layer platform-shaped apex portion between the plurality of inner layer grooves.

The coating layer may be configured with a flat coating layer platform-shaped apex portion between the plurality of coating layer grooves.

The plurality of inner layer grooves may have a pitch of 500 to 1500 μm.

The plurality of inner layer grooves may have a width of 25 to 1300 μm.

The plurality of inner layer grooves may have a depth of 25 to 500 μm.

The plurality of inner layer grooves may have a V-shaped cross-section and a groove angle of 50 to 120 degrees.

Effects of the Invention

Because an elastic roller according to the present description includes an inner layer elastic material member disposed on an outer periphery of the roller shaft and the coating layer composed of a silicone resin having a C hardness of 20 degrees that is in contact with the belt-shaped member disposed on an outer periphery of the inner layer elastic material member, as an elastic material member, the resin may provide a non-stick property or a release property with respect to an adhesive agent layer, and may provide the necessary frictional force (gripping force) and anti-wear property with respect to the belt-shaped member due to gelated resin having low hardness (C hardness of 20 degrees or less).

In addition, the elastic roller includes a second side end part direction sloping circumferential surface having an elastic roller diameter that gradually decreases towards a second side end part opposite to a first side end part in an axial direction of the roller shaft of the elastic roller. Accordingly, feeding of the belt-shaped member is assured in a region on a circumferential surface of the first side end part other than the second side end part direction sloping circumferential surface, even in a case where a belt-shaped member such as a linerless label having a narrow width has been loaded by the feeding-to-one-side method on a first side end part in a width direction according to the elastic roller. Further, the elastic roller avoids contact (or, demonstrates a degree of influence considered to be negligible even in a case of contact) with an opposing thermal head or the like in a region of the second side end part direction sloping circumferential surface where the belt-shaped member is not present, so as to allow stable feeding and guidance even in a case where a belt-shaped member such as a typical label with a liner or linerless label having a different width has been loaded.

BRIEF DESCRIPTION OF THE DRAWINGS

FIG. 2, similarly, shows a cross-sectional view of an axial direction of the platen roller 220, and a view seen from a feeding direction of a linerless label 1 of the platen roller 220 (see, FIG. 2) and a thermal head 16 in a thermal printer 8 (see, FIG. 14) or the like;

DETAILED DESCRIPTION OF THE INVENTION

An elastic roller in a present disclosure includes a coating layer composed of a silicone resin having C hardness of 20 degrees or less that is in contact with a belt-shaped member disposed on an outer periphery of an inner layer elastic material member. The elastic roller possesses a non-stick property or a release property with respect to an adhesive agent layer and required frictional force (gripping force) and an anti-wear property with respect to a belt-shaped member. Because the elastic roller has been formed such that a second side end part direction sloping circumferential surface has an elastic roller diameter that gradually decreases towards a second side end part opposite to a first side end part in an axial direction of a roller shaft, a belt-shaped member such as a linerless label or a typical label with a liner may be stably fed and guided to one side, even in a case where the belt-shaped member has a comparatively narrow width.

Embodiments

Figure 13:
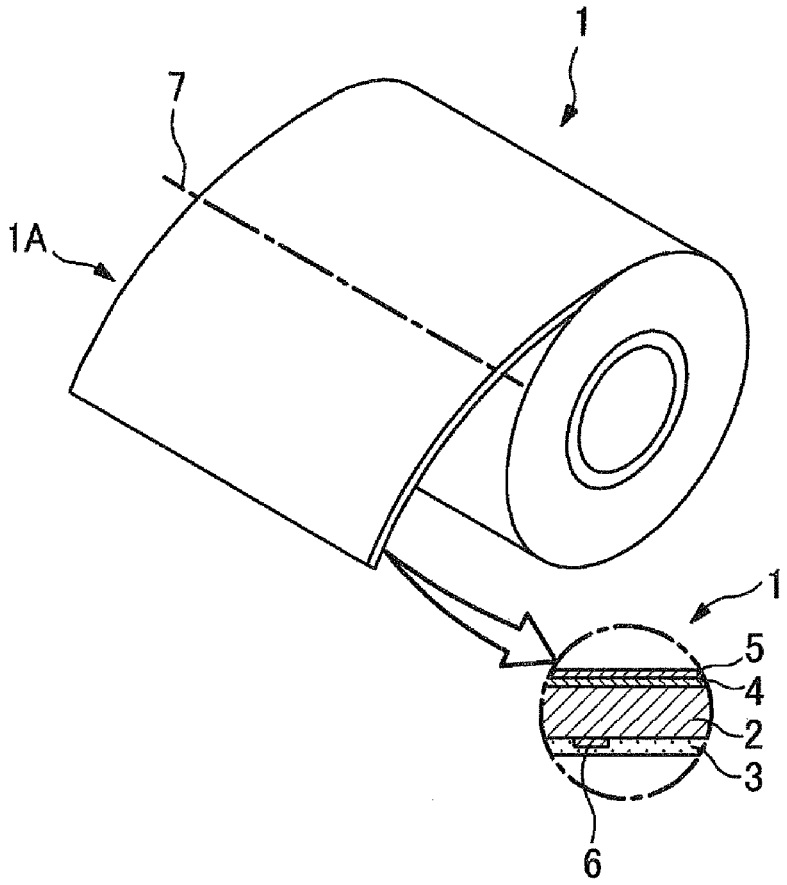
FIG. 13 shows a perspective view of a conventional linerless label 1 wound into rolled configuration.

Next, the elastic roller according to a first embodiment of the present disclosure will be described based on FIGS. 1 and 2, e.g., the elastic roller configured as a platen roller 220 (elastic roller for label) in a thermal printer 8, similarly to a platen roller 17 (see, FIG. 14). However, a detailed description of similar numerals appended to a similar portion of FIGS. 13 and 14 has been omitted.

Figure 1:
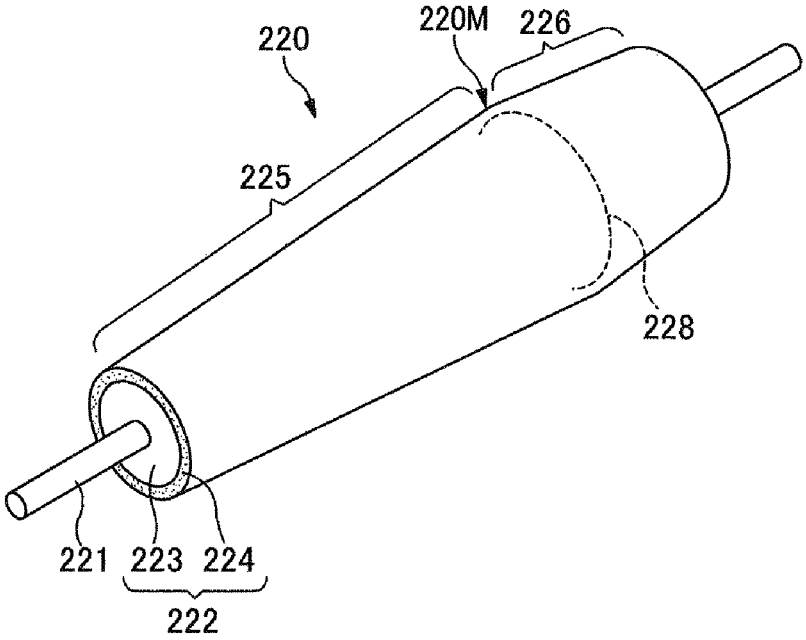
FIG. 1 shows a perspective view of an elastic roller (a platen roller 220) according to a first embodiment of a present disclosure.
Figure 2:
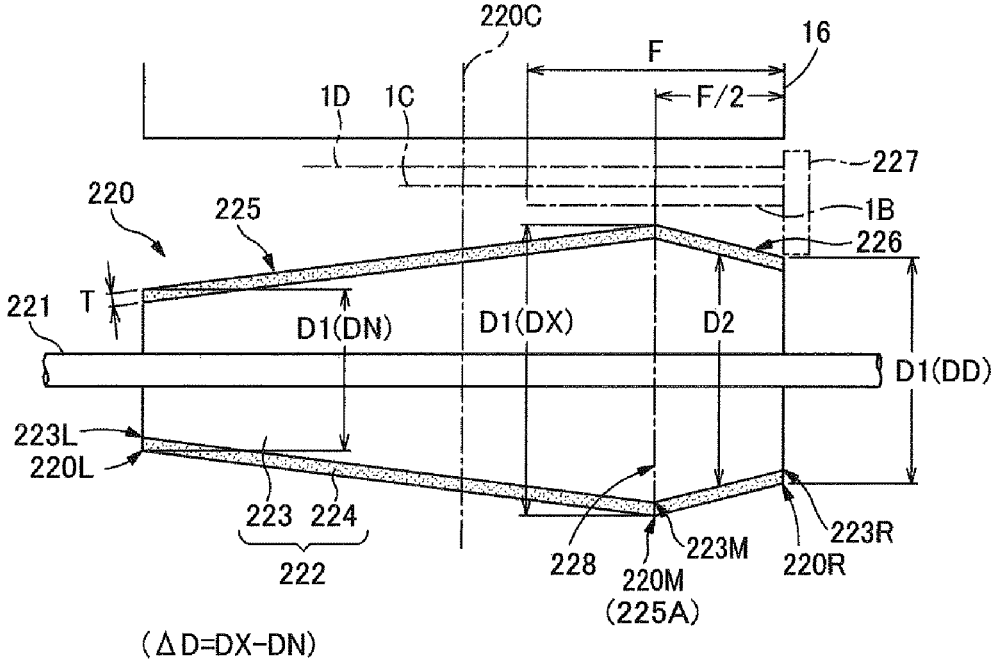

FIG. 1 shows a perspective view of the platen roller 220; and FIG. 2 shows a view of a cross-section of an axial direction of the platen roller 220, and a view as seen from a feeding direction of a linerless label 1 of the platen roller 220 (see, FIG. 2) and a thermal head 16 in the thermal printer 8 (see, FIG. 14) or the like. The platen roller 220 includes a roller shaft 221, and an elastic material member 222 that attaches to a periphery of the roller shaft 221 and is integrally rotatable together with the roller shaft 221. The platen roller 220 feeds the label (e.g., the linerless label 1; see, FIG. 13) by bringing the label into contact with the elastic material member 222.

The elastic material member 222 includes a "substantially asymmetrically cylinder-shaped" (see, FIG. 2) inner layer elastic material member 223 disposed on an outer periphery of the roller shaft 221, and a coating layer 224 (outer layer side elastic material member) that is integrally disposed on an outer periphery of the inner layer elastic material member 223 and that contacts the linerless label 1.

The inner layer elastic member 223 may be composed of a thermoplastic material or a thermosetting elastomeric material.

For example, polyethylene, polypropylene, polymethylpentene, polybutene, crystallized polybutadiene, polybutadiene, styrene-butadiene resin, polyvinyl chloride, polyvinyl acetate, polyvinylidene chloride, ethylene-vinyl acetate copolymer, ethylene-propylene copolymer, ethylene-propylene-diene copolymer, ionomer, polymethyl-methacrylate, polytetrafluoroethylene, ethylene-polytetrafluoroethylene copolymer, polyacetal(polyoxymethylene), polyamide, polycarbonate, polyphenyleneether, polyethylene terephthalate, polybutylene terephthalate, polyarylate, polystyrene, polyethersulfone, polyimide, polyamide-imide, polyphenylenesulfide, polyoxybenzoyl, polyether ether ketone, polyetherimide, polyurethane, polyester, 1,2-polybutadiene, phenol resin, urea resin, melamine resin, benzoguanamine resin, diallyl phthalate resin, alkyd resin, epoxy resin, or silicon resin may be employed as the synthetic resin usable for the inner layer elastic material member 223.

In addition, a thermosetting elastomeric material such as a thermosetting silicone rubber, a one-liquid type RTV (Room Temperature Vulcanizing) rubber, a two-liquid type RTV rubber, an LTV (Low Temperature Vulcanizable) silicone rubber, or an oil resistant thermosetting rubber may be used as the inner layer elastic material member 223.

The inner layer elastic material member 223 has hardness of 30 to 80 degrees (rubber hardness according to a Durometer Hardness Testing Method Type A defined in JIS K6253, hereinafter referred to as "A hardness").

In a case where an A hardness is below 30 degrees, the degree of hardness is too soft for the platen roller 220 to feed and guide a belt-shaped member such as the linerless label 1, i.e., a feeding function of the platen roller 220 does not perform properly because of excessive contact and frictional force. Moreover, a printing quality of the thermal printer 8 (see, FIG. 14) is reduced.

In a case where an A hardness exceeds 80 degrees, the degree of hardness is too hard for the platen roller 220, such that the feeding force and the feeding precision thereof are reduced.

The coating layer 224 is composed of a silicone resin such as a heat-curable silicone resin having a C hardness (hardness according to a spring type hardness tester Asker C in accordance with SRIS 0101, hereinafter referred to as "C hardness") of 20 degrees or less.

For example a silicone resin such as silicone gel, a RTV (Room Temperature Vulcanizing) liquid silicone rubber, an LTV (Low Temperature Vulcanizable) liquid silicone rubber, an ultraviolet light curable liquid silicone rubber, or a thermosetting liquid silicone rubber may be used as the silicone rubber.

The silicone resin inherently possesses a non-sticky property or a release property, and the silicone resin may prevent attachment by the adhesive agent layer 3 of the linerless label 1 even in a case where the linerless label 1 or the like is pressed thereagainst and fed.

A thermosetting silicone resin may also be easily set to a C hardness of the coating layer 224 by a relatively simple preparation and manufacturing process under thermosetting conditions.

In a case where a C hardness of the coating layer 224 is 20 degrees or less, the silicone resin is in a gel form of the appropriate softness. The linerless label 1 clearly also possesses a necessary frictional force (gripping power) with respect to a belt-shaped member such as the linerless label 1 and a superior anti-wear property.

Therefore, the platen roller 220 also includes the necessary release property and the gripping force with respect to belt-shaped member such as a linerless label 1 or a label with a liner. Accordingly, the platen roller 220 is able to provide stable feeding and guidance function.

In a case where the C hardness of the coating layer 224 exceeds 20 degrees, the elastic property of the coating layer 224 approaches that of a rubber material. Thus, an adhesive property of a surface of the coating layer 224 is dramatically increased, and the coating layer 224 is easily worn down.

In particular, as shown in FIG. 2, the platen roller 220 (elastic roller) includes a second side end part direction sloping circumferential surface 225 having an elastic roller diameter D1 that gradually decreases from a maximum diameter part 220M to a second side end part 220L (see, left side of FIG. 2) opposite to a first side end part 220R (see, right side of FIG. 2), in an axial direction of the roller shaft 221. The platen roller 220 also includes a first side end part direction sloping circumferential surface 226 having an elastic roller diameter D1 that gradually decreases from a maximum diameter part 220M to the first side end part 220R, in an axial direction of the roller shaft 221. More specifically, the elastic roller diameter D1 of the platen roller 220 has a maximum diameter DX in a maximum diameter part 220M between a center part 220C of the elastic material member 222 and the first side end part 220R along the axial direction of the roller shaft 221. Moreover, the elastic roller diameter D1 has a minimum diameter DN in the second side end part 220L, and an intermediate diameter DD, which may be any value defined between the maximum diameter DX and the minimum diameter DN in the first side end part 220R.

As described above, the second side end part direction sloping circumferential surface 225 and the first side end part direction sloping circumferential surface 226 are formed such that a left-to-right shape of the elastic roller 220 is asymmetrical with respect to a center part 220C of the elastic material member 222 along the axial direction of the roller shaft 221. It should be noted that the second side end part direction sloping circumferential surface 225 may be formed such that a sloping circumferential surface starting part 225A is at any part in the axial direction of the elastic material member. In the example illustrated in the figure, the sloping circumferential surface starting part corresponds to the maximum diameter part 220Ms.

With regard to the elastic roller diameter D1, a difference $\Delta D = DX - DN$ between the maximum diameter DX in the maximum diameter part 220M and the minimum diameter DN in second side end part 220L in an axial direction of the roller shaft 221, is 10 to 180 μm. In a case where the difference ΔD is less than 10 μm, there is almost no change in the platen roller 220 with respect to a typical cylindrically shaped platen roller, and thus it becomes difficult for the platen roller 220 to avoid contact (or, demonstrate a degree of influence considered to be negligible even in a case of contact) with an opposing thermal head 16 (see, FIG. 14) or the like. In a case where the difference ΔD exceeds 180 μm, it is possible that a feedable linerless label sandwiched on one side between the elastic roller and the thermal head 16 or the like will be limited to be narrow one.

The thermal printer 8 (see, FIG. 14) includes a label single-side guide material member 227 for controlling and guiding the linerless label 1 in a first-side direction at one side edge part (width direction part) with respect to a feeding direction of the linerless label 1. The maximum diameter part 220M of the platen roller 220 is positioned at a center in a width direction of a linerless label 1 having a minimum width among a plurality of types of loaded and fed linerless labels 1 in feeding-to-one-side method which are limited by the label single-side guide member material 227. In other words, an interval between the first side end part 220R of the platen roller 220 or the label single-side guide material member 227 of the linerless label 1 and the maximum diameter part 220M is equal to a length (F/2) of half a width of the linerless label 1 having a minimum width F.

As previously described, the second side end part direction sloping circumferential surface 225 and the first side end part direction sloping circumferential surface 226 are formed in the elastic roller 220 such that the elastic roller diameter D1 of the elastic roller 220 continuously and gradually decreases from the center part 220C of the elastic material member 222 to the first side end part 220R along the axial direction of the roller shaft 221, and such that the elastic roller diameter D1 of the elastic roller 220 continuously and gradually decreases from the center part 220C of the elastic material member 222 to the second side end part 220L that opposes the first side end part 220R along the axial direction of the roller shaft 221.

Accordingly, the platen roller 220 exhibits a "substantially asymmetrically cylinder shape". The roller shaft 221 is a typical cylindrical shaft that has a constant diameter along the axial direction. In addition, the coating layer 224 has a uniform coating layer thickness T along the axial direction of the roller shaft 221. In other words, the inner layer elastic material member 223 in the platen roller 220 has the inner layer elastic material member diameter D2 of the roller shaft 221 that gradually decreases from the maximum diameter part 223M to both (left and right) end parts (first side end part 223R and second side end part 223L opposite to the first side end part 223R) along the axial direction of the roller shaft 221, similar to the outer shape of the platen roller 220.

The coating layer 224 has a coating layer thickness T (see, FIG. 2) of 10 to 100 μm. In a case where the coating layer thickness T is less than 10 μm, a coating thickness on the coating layer 224 is uneven, and a stable release property and a gripping force are not easily obtained. In a case where the coating layer thickness T exceeds 100 μm, the coating of the inner layer elastic material member 223 in the platen roller 220 becomes fragile and easily damaged.

A length (F/2) of half a width of a linerless label 1 having a minimum width F among the linerless labels 1 that are fed using the platen roller 220 may be indicated, i.e., by presetting a clearly viewable maximum diameter location mark 228 for indicating the maximum diameter part 223M on at least one of the maximum diameter part 220M of the elastic material member 222, i.e., of the platen roller 220, or the maximum diameter part 223M of the inner layer elastic material member 223. The application of the maximum diameter location mark 228 may optionally include coloring, and may be performed continuously or discontinuously in a circumferential direction of the elastic material member 222.

Next, a roll-angle test (measurement method of a roll-angle) will be described as a test that evaluates a non-stick property (release property) for an elastic roller according to the present disclosure.

The linerless label 1 is fixed on top of a flat horizontal base, such that the adhesive agent layer 3 of the linerless label 1 faces upwards.

The platen roller 220 is mounted on the adhesive agent layer 3 as a test sample, a 2 Kg weight is applied for 15 seconds from the top of the platen roller 220, and the platen roller 220 is attached to the linerless label 1.

The weight is removed after 15 seconds, and then, one end portion of a base plate parallel to an axial line of the platen roller 220 is fixed and the base plate continues to slant via a gradual rise in the other end.

Slanting of the base plate ends at a time point where downward movement of the platen roller 220 begins, and base plate angle of gradient (i.e., roll angle) is then read out at the above time point.

The easy-to-roll platen roller 220 due to a low angle of gradient (roll angle) possesses a high non-stick property, and is preferable for feeding the linerless label 1.

Figure 14:
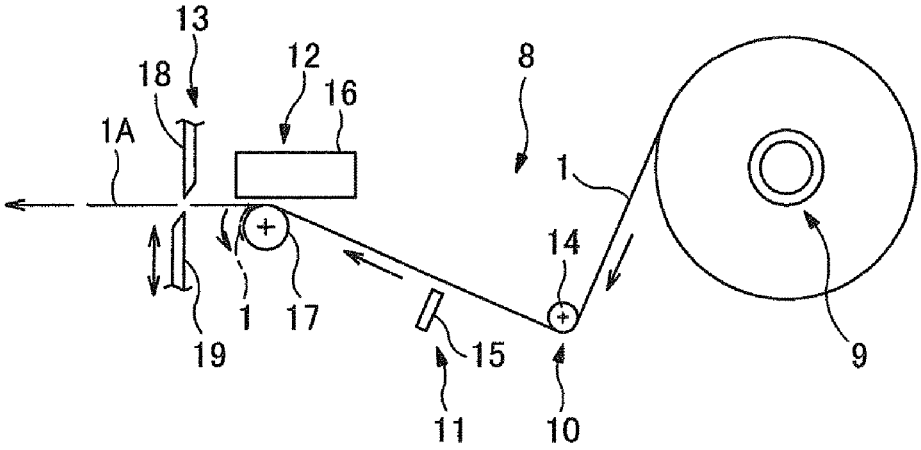
FIG. 14, similarly, shows a schematic side view of the same loaded linerless label 1 and the thermal printer 8 for printing variable information such as merchandise information such as a price or a barcode of merchandise or administrative information relating a product or a service where appropriate.

According to the test performed by the present inventor, it was found that when a roll angle of the linerless label 1 used in the elastic roller was no more than 15 degrees, after being fed over a distance of 20 Km, the elastic roller displayed no problems with respect to practical usage as the platen roller 17 or a nip roller in thermal printer 8 (see, FIG. 14).

A feeding test for the linerless label 1 and the label with a liner was conducted using the platen roller 220 constructed as described above.

With respect to the inner layer elastic material member 223, a thermosetting silicone rubber having a maximum diameter DX of 10.15 mm, a minimum diameter DN of 10.05 mm and an intermediate diameter DD of 10.10 mm was used. Then, a coating layer 224 composed of a thermosetting silicone rubber (silicone gel) having C hardness of 15 degrees was formed with a uniform coating layer thickness T of 50 μm at outer periphery of the inner layer elastic material member 223 to obtain a platen roller 220.

The platen roller 220 according to the present disclosure described above and a conventional cylindrically-shaped platen roller (comparative product) that does not include the coating layer 224 were prepared, and the linerless label 1 and the label with a liner were fed while being guided to one side via the label single-side guide material member 227. As shown in FIG. 2, in a case where the linerless label 1 has a minimum width F, the linerless label 1 was fed so that an edge part of the linerless label 1 in the width direction abutted the label single-side guide material member 227. In a case where the linerless label 1 has a minimum width F, the maximum diameter part 220M is located at a position separated from the label single-side guide material member 227 by a length F/2 that corresponds to half the width thereof. Even in a case of the linerless label 1 having a width broader than a minimum width F, linerless label 1 was fed so that the edge part of the linerless label 1 in the width direction abutted the label single-side guide material member 227 and the linerless label 1 was guided thereby.

After the platen roller 220 according the present disclosure fed the linerless label 1 and the label with a liner for a distance of 20 km, the roll angle for the linerless label 1 was below 15 degrees and the roll angle for the label with a liner was below 9 degrees. Accordingly, it was understood that a release property for either the linerless label 1 or the label with a liner was sufficient for the elastic roller. It was also understood that a gripping force for a label was sufficient for the elastic roller, since feeding was performed normally.

Moreover, it is desirable that a wear level in a diameter of the elastic roller due to wear be 1% or less after the linerless label 1 or the label with a liner is fed for a distance of 20 Km using an elastic roller in a printer such as the thermal printer 8.

In the abovementioned test, the wear level of the platen roller 220 was 0.05% or less after the linerless label 1 was fed for a distance of 20 Km. Moreover, the wear level of the platen roller 220 at the time the label with a liner was fed for a distance of 50 Km was 0.5% or less.

On the other hand, the linerless label 1 was wound around a comparative product (conventional cylindrical platen roller without a coating layer 224) after being fed for a distance of 0.5 Km. A measured roll angle exceeded 70 degrees by using the linerless label 1, and the comparative product was found to be incompatible for a usage of the linerless label 1.

Accordingly, a configuration having a release property and a gripping force has been obtained by the platen roller 220 having the coating layer 224 coated onto the inner layer elastic material member 223.

As shown in FIG. 2, with respect to the linerless label 1 sandwiched between the thermal head 16 and the platen roller 220 in the thermal printer 8 (see, FIG. 14) or the like, even in a case where a linerless label having a narrow width 1B (e.g., 50 mm width) is fed and printed by being sandwiched between the 101.6 mm width (four-inch model) thermal head 16 and the platen roller 220, so long as the linerless label having a narrow width 1B that is narrower than the platen roller 220 is fed to have a maximum pressing force at the maximum diameter part 220M of the platen roller 220, as a result of the platen roller 220 having a so-called "substantially asymmetrically cylinder-shape," the thermal head 16 does not contact or slightly contact with the platen roller 220 on the second side end part 220L of the platen roller 220 that lacks the linerless label 1B, and thus printing and feeding will likewise not be impeded. Moreover, even in the case of feeding and printing by sandwiching a narrow width label with a liner (e.g., 53 mm width; not shown) between the four-inch model thermal head 16 and the platen roller 220, the required gripping force was provided, and thus the printing and the feeding was similarly not impeded.

Even in the case of feeding and printing by sandwiching a linerless label having a broad width 1C, 1D, or the like, between the thermal head 16 and the platen roller 220, the maximum pressing force may be ensured at the maximum diameter part 220M. Further, because the elastic roller diameter D1 is gradually reduced by the second side end part direction sloping circumferential surface 225 in a vicinity of the second side end part 220L of the platen roller 220, there is no direct contact between the platen roller 220 and the thermal head 16, and printing and feeding are not impeded.

In the present disclosure, a configuration of the second side end part direction sloping circumferential surface 225 having an elastic roller diameter D1 of the elastic roller (platen roller 220) that gradually decreases, and a configuration having a maximum diameter DX at the maximum diameter part 220M between the center part 220C of the elastic material member 222 and the first side end part 220R along an axial direction of the roller shaft 221 that gradually decreases towards both end parts (the first side end part 220R and the second side end part 220L), may be implemented other than a first embodiment shown in FIG. 2.

Figure 3:
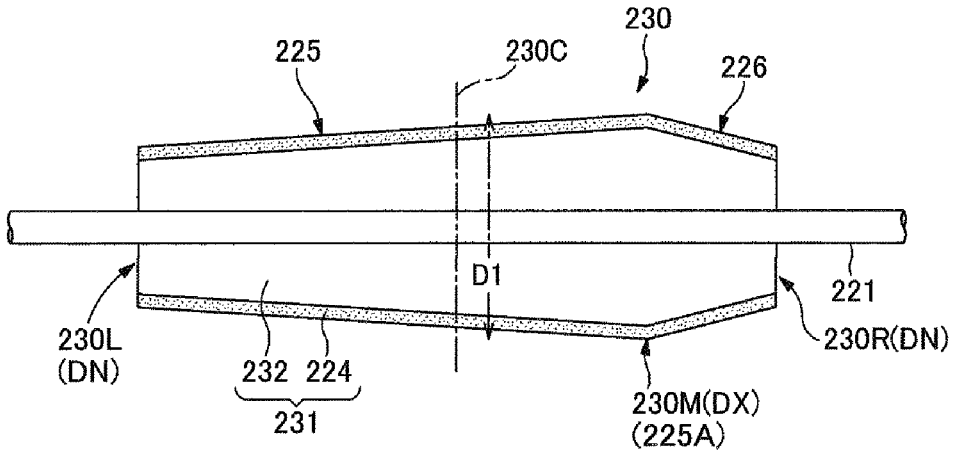
FIG. 3 shows a cross-sectional view of an axial direction of the elastic roller (a platen roller 230) according to a second embodiment of the present disclosure.

In other words, with respect to a configuration of the second side end part direction sloping circumferential surface 225 having an elastic roller diameter D1 of the elastic roller (platen roller 220) that gradually decreases, any configuration or embodiment may be employed so long as the maximum diameter part 220M has the maximum diameter DX. For example, FIG. 3 is a cross-sectional view of an axial direction of the elastic roller (platen roller 230) according to a second embodiment of the present disclosure. The platen roller 230 includes a roller shaft 221 and an elastic material member 231, similarly to the platen roller 220. The elastic material member 231 includes a "substantially asymmetrically cylinder-shaped" inner layer elastic material member 232 disposed on an outer periphery of the roller shaft 221, and the coating layer 224 (outer layer side elastic material member) in direct contact with linerless label 1 that is integrally disposed at an outer periphery of the inner layer elastic material member 232.

The platen roller 230 has a maximum diameter DX at a maximum diameter part 230M that is positioned between a center part 230C of the elastic material member 231 and a first side end part 230R along an axial direction of the roller shaft 221, similarly to the platen roller 220 (see, FIG. 2). In addition, the platen roller 230 includes the first side end part direction sloping circumferential surface 226 that is formed from the maximum diameter part 230M to the first side end part 230R, and the second side end part direction sloping circumferential surface 225 that is formed from the maximum diameter part 230M to the second side end part 230L that opposes the first side end part 230R. The first side end part direction sloping circumferential surface 226 and the second side end part direction sloping circumferential surface 225 have an identical minimum diameter DN at the first side end part 230R and the second side end part 230L respectively. In other words, the elastic roller diameter D1 continuously and gradually decreases along the first side end part direction sloping circumferential surface 226 from the maximum diameter part 230M to the first side end part 230R along the axial direction of the roller shaft 221, and the elastic roller diameter D1 continuously and gradually decreases along the second side end part direction sloping circumferential surface 225 from the maximum diameter part 230M to the second side end part 230L. Further, the coating layer 224 has a uniform coating layer thickness T along an axial direction of the roller shaft 221.

Even in the platen roller 230 of the above configuration, the linerless label 1 or the label with a liner may be fed without hindrance, similarly to the platen roller 220 (see, FIGS. 1 and 2). Specifically, the platen roller 230 has the identical minimum diameter DN for both the first side end part 230R and the second side end part 230L. Accordingly, the platen roller 230 may be produced by a simpler process than the platen roller 220.

Figure 4:
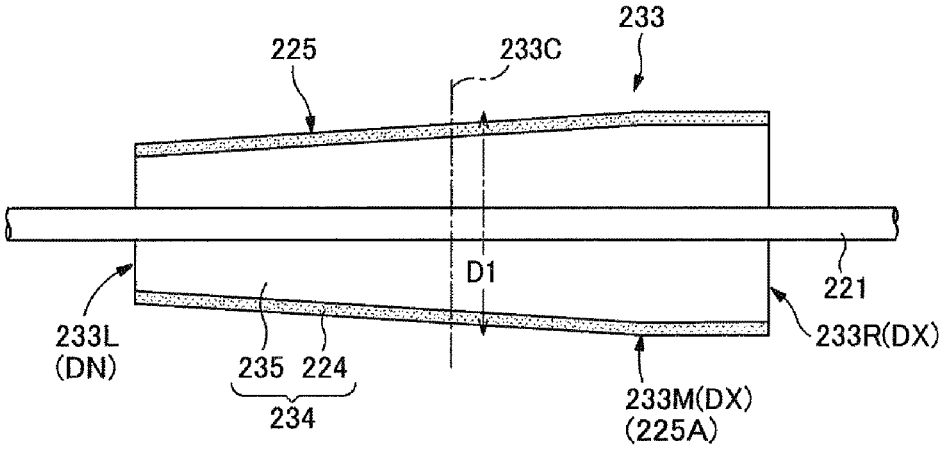
FIG. 4 shows a cross-sectional view of an axial direction of the elastic roller (a platen roller 233) according to a third embodiment of the present disclosure.

FIG. 4 is a cross-sectional view of an axial direction of the elastic roller (a platen roller 233) according to a third embodiment of the present disclosure. The platen roller 233 includes the roller shaft 221 and the elastic material member 234, similarly to the platen roller 220. The elastic material member 234 includes a "modified asymmetrically cylinder-shaped" inner layer elastic material member 235 disposed on an outer periphery of the roller shaft 221 and the coating layer 224 (outer layer side elastic material member) in direct contact with linerless label 1 that is integrally disposed at an outer periphery of the inner layer elastic material member 235. The elastic roller diameter D1 of the platen roller 233 has a maximum diameter DX from a maximum diameter part 233M, which is positioned between a center part 233C of the elastic material member 234 and a first side end part 233R, to a first side end part 233R along an axial direction of the roller shaft 221. In other words, the coating layer 224 is coated from the maximum diameter part 233M to the first side end part 233R coaxially with the roller shaft 221. In addition, the elastic roller diameter D1 of the platen roller 233 has a minimum diameter DN at the second side end part 233L, and the elastic roller diameter D1 gradually decreases from the maximum diameter part 233M towards the second side end part 233L by the formation of the second side end part direction sloping circumferential surface 225.

Thus, the platen roller 233 has a "modified asymmetrically cylindrical shape." In other words, a typical cylindrical shape is formed from the maximum diameter part 233M to the first side end part 233R, and an elongated tapered conical shape is formed from the maximum diameter part 233M to the second side end part 233L by the formation of the second side end part direction sloping circumferential surface 225. Accordingly, the platen roller 233 may make contact with the linerless label 1 across the overall outer peripheral region between the maximum diameter part 233M and the first side end part 233R.

Even in the platen roller 233 of the above configuration, the linerless label 1 or the label with a liner may be fed without hindrance, similarly to the platen roller 220 (see, FIGS. 1 and 2). Specifically, with respect to the platen roller 233, the elastic roller diameter D1 is such that the maximum diameter DX is sustained from the first side end part 233R or the label single-side guide material member 227 to the maximum diameter part 233M. Accordingly, the linerless label 1 may be precisely fed.

Figure 5:
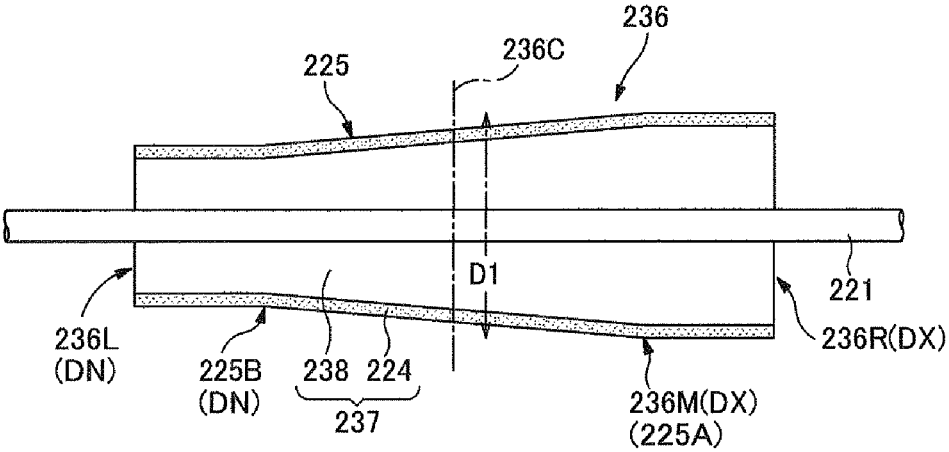
FIG. 5 shows a cross-sectional view of an axial direction of the elastic roller (a platen roller 236) according to a fourth embodiment of the present disclosure.

FIG. 5 is a cross-sectional view of an axial direction of the elastic roller (a platen roller 236) according to a fourth embodiment of the present disclosure. The platen roller 236 includes the roller shaft 221 and the elastic material member 237, similarly to the platen roller 220. The elastic material member 237 includes a "modified asymmetrically cylinder-shaped" inner layer elastic material member 238 disposed on an outer periphery of the roller shaft 221 and the coating layer 224 (outer layer side elastic material member) in direct contact with the linerless label 1 that is integrally disposed at an outer periphery of the inner layer elastic material member 238. The elastic roller diameter D1 of the platen roller 236 has a maximum diameter DX from a maximum diameter part 236M, which is positioned between a center part 236C of the elastic material member 237 and a first side end part 233R, to a first side end part 236R along an axial direction of the roller shaft 221. In other words, the coating layer 224 is coated from the maximum diameter part 236M to the first side end part 236R, coaxially with the roller shaft 221. The second side end part direction sloping circumferential surface 225 is formed from the maximum diameter part 236M towards the second side end part 236L, and the platen roller 236 has a minimum diameter DN at both a sloping circumferential surface ending part 225B and the second side end part 236L.

Accordingly, the platen roller 236 has a "modified asymmetrical cylindrical shape." In other words, the platen roller 236 has a typical cylindrical shape formed from the maximum diameter part 236M to the first side end part 236R, and an elongated tapered conical shape formed from the maximum diameter part 236M to the second side end part 236L via the second side end part direction sloping circumferential surface 225. In addition, a typical cylindrical shape is formed from the sloping circumferential surface ending part 225B to the second side end part 236L. The linerless label 1 may make contact with the overall outer peripheral region between the maximum diameter part 236M and the first side end part 236R, and the linerless label 1 may decrease or avoid contact with the overall outer peripheral region between the sloping circumferential surface ending part 225B and the second side end part 236L.

Even in the platen roller 236 of the above configuration, the linerless label 1 or the label with a liner may be fed without hindrance, similarly to the platen roller 220 (see, FIGS. 1 and 2). Specifically, as a result of the platen roller 236 having a minimum diameter DN from the sloping circumferential surface ending part 225B to the second side end part 236L, the thermal head 16 and the platen roller 236 are not strongly pressed together so as to make contact. Accordingly, unsatisfactory feeding or wear of the platen roller 236 may be prevented.

Figure 6:
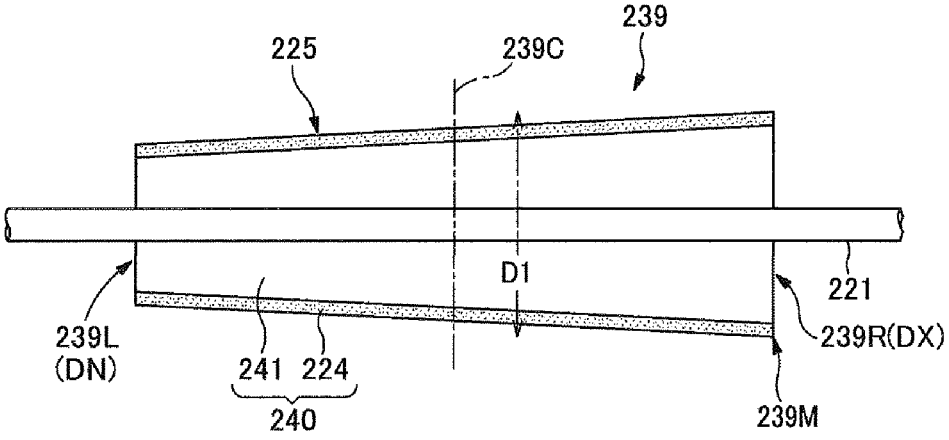
FIG. 6 shows a cross-sectional view of an axial direction of the elastic roller (a platen roller 239) according to a fifth embodiment of the present disclosure.

FIG. 6 is a cross-sectional view of an axial direction of the elastic roller (a platen roller 239) according to a fifth embodiment of the present disclosure. The platen roller 239 includes the roller shaft 221 and the elastic material member 240, similarly to the platen roller 220. The elastic material member 240 includes a "modified asymmetrically cylinder-shaped" (elongated tapered conically-shaped) inner layer elastic material member 241 disposed on an outer periphery of the roller shaft 221 and the coating layer 224 (outer layer side elastic material member) in direct contact with the linerless label 1 that is integrally disposed at an outer periphery of the inner layer elastic material member 241. The elastic roller diameter D1 of the platen roller 239 continuously and gradually decreases via the second side end part direction sloping circumferential surface 225 that is formed from the first side end part 239R through the center part 239C to the second side end part 239L that opposes the first side end part 239R along the axial direction of the roller shaft 221. The first side end part 239R is the maximum diameter part 239M, and the platen roller 239 has a maximum diameter DX at the first side end part 239R. The platen roller 239 has a minimum diameter DN at the second side end part 239L. In other words, an inner layer elastic material member 241 has an elongated tapered conical shape similar to that of the platen roller 239. The coating layer 224 is coated from the maximum diameter part 239M to the second side end part 239L, at the same coating thickness.

Accordingly, the platen roller 239 has a "modified asymmetrical cylindrical shape." In other words, the platen roller 239 has an elongated tapered conical shape formed from the first side end part 239R (maximum diameter part 239M) to the second side end part 239L. Contact between the linerless label 1 and an outer peripheral region at the maximum diameter part 239M (first side end part 239R) may be made. Contact between the linerless label 1 and the overall outer peripheral region of the second side end part direction sloping circumferential surface 225, which is formed between the first side end part 239R and the second side end part 239L, may be reduced or avoided, depending on the size (width) of the linerless label 1.

Even in the platen roller 239 of the above configuration, the linerless label 1 or the label with a liner may be fed without hindrance, similarly to the platen roller 220 (see, FIGS. 1 and 2). Specifically, as a result of the platen roller 239 having a maximum diameter part 239M that slightly bends in the axial direction to correspond to printing pressure (pressing force) between the maximum diameter part 239M and the thermal head 16, it is possible to feed the linerless label 1 or a label with a liner having a very narrow width. Moreover, as a result of the platen roller 239 that has a maximum diameter DN at the second side part 239L, the thermal head 16 and the platen roller 239 are not strongly pressed together. Accordingly, unsatisfactory feeding or wear of the platen roller 239 may be prevented.

Figure 7:
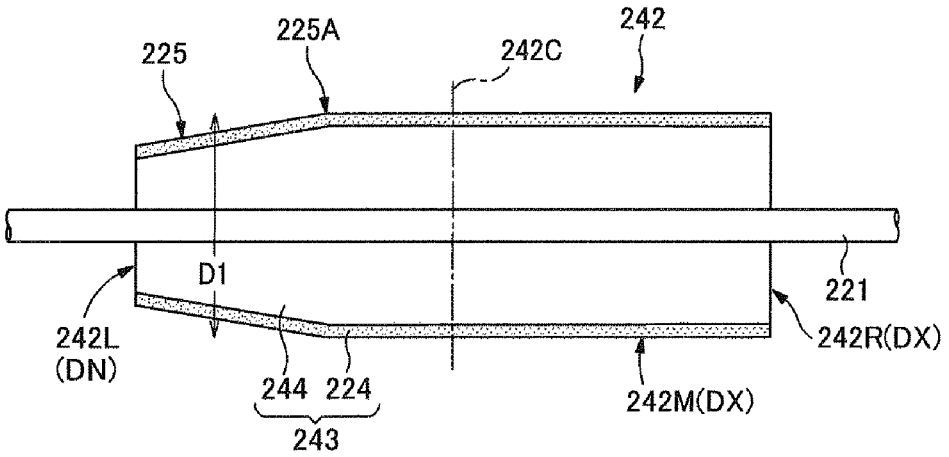
FIG. 7 shows a cross-sectional view of an axial direction of the elastic roller (a platen roller 242) according to a sixth embodiment of the present disclosure.

FIG. 7 is a cross-sectional view of an axial of the elastic roller (a platen roller 242) according to a sixth embodiment of the present disclosure. The platen roller 242 includes the roller shaft 221 and the elastic material member 243, similarly to the platen roller 220. The elastic material member 243 includes a "modified asymmetrically cylinder-shaped" (elongated tapered conically-shaped) inner layer elastic material member 244 disposed on an outer periphery of the roller shaft 221 and the coating layer 224 (outer layer side elastic material member) in direct contact with the linerless label 1 that is integrally disposed at an outer periphery of the inner layer elastic material member 244. The elastic roller diameter D1 of the platen roller 242 is a constant diameter in a region that extends from the first side end part 242R through the center part 242C to the sloping circumferential surface starting part 225A facing the second side end part 242L that opposes the first side end part 242R along the axial direction of the roller shaft 221. However, elastic roller diameter D1 continuously and gradually decreases from the sloping circumferential surface starting part 225A of the second side end part direction sloping circumferential surface 225 to the second side end part 242L. The platen roller 242 has a maximum diameter part 242M extending from the first side end part 242R across the center part 242C to the sloping circumferential surface starting part 225A. The elastic roller diameter D1 is a maximum diameter DX at the first side end part 242R, and is a minimum diameter DN at the second side end part 242L. In other words, an inner layer elastic material member 244 has an elongated tapered conical shape similar to that of the platen roller 242. The coating layer 224 is coated from the maximum diameter part 242M (the first side end part 242R) to the second side end part 242L, at the same coating thickness.

Accordingly, the platen roller 242 has a "modified asymmetrical cylindrical shape." In other words, the platen roller 242 has a typical cylindrical shape formed from the first side end part 242R (maximum diameter part 242M) that opposes the second side end part 242L, crossing through the center part 242C to the sloping circumferential surface starting part 225A, such that contact may be made by the linerless label 1 and the overall outer peripheral region of the cylindrical shape, and such that contact by the linerless label 1 and the overall outer peripheral region of the second side end part direction sloping circumferential surface 225 may be reduced or avoided between the second side end part 242L and the sloping circumferential surface starting part 225A, depending on the size (width) of the linerless label 1.

Even in the platen roller 242 of the above configuration, the linerless label 1 or the label with a liner may be fed without hindrance, similarly to the platen roller 220 (see, FIGS. 1 and 2).

Specifically, the platen roller 242 has a maximum diameter part 242M (which extends from the first side end part 242R to the sloping circumferential surface starting part 225A) that allows for feeding of the linerless label 1 or the label with a liner, and the thermal head 16 and the platen roller 242 are not strongly pressed together so as to make contact at a part of an outer peripheral surface of the second side end part direction sloping circumferential surface 225 that extends from the sloping circumferential surface starting part 225A to the second side end part 242L. Accordingly, unsatisfactory feeding or wear of the platen roller 242 may be prevented.

Figure 8:
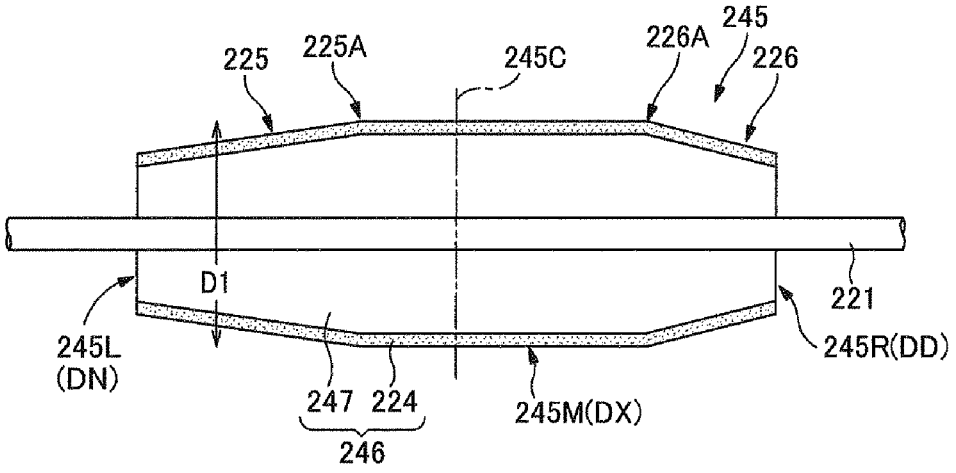
FIG. 8 shows a cross-sectional view of an axial direction of the elastic roller (a platen roller 245) according to a seventh embodiment of the present disclosure.

FIG. 8 is a cross-sectional view of an axial of the elastic roller (a platen roller 245) according to a seventh embodiment of the present disclosure. The platen roller 245 includes the roller shaft 221 and the elastic material member 246, similarly to the platen roller 220. The elastic material member 246 includes a "modified asymmetrically cylinder-shaped" (elongated tapered conical-shaped) inner layer elastic material member 247 disposed on an outer periphery of the roller shaft 221 and the coating layer 224 (outer layer side elastic material member) in direct contact with the linerless label 1 that is integrally disposed at an outer periphery of the inner layer elastic material member 247. With respect to the second side end part direction sloping circumferential surface 225, the elastic roller diameter D1 of the platen roller 245 continuously and gradually decreases from the sloping circumferential surface starting part 225A towards the second side end part 242L that opposes the first side end part 242R to the second side end part 242L. With respect to the first side end part direction sloping circumferential surface 226, the elastic roller diameter D1 continuously and gradually decreases from the sloping circumferential surface starting part 226A towards the first side end part 242R to the first side end part 242R. However, the maximum diameter part 245M is formed in a region that includes the center part 245C of the elastic material member 246 along the axial direction of the roller shaft 221, between the sloping circumferential surface starting part 225A of the second side end part direction sloping circumferential surface 225 and the sloping circumferential surface starting part 226A of the first side end part direction sloping circumferential surface 226. The elastic roller diameter D1 of the maximum diameter part 245M (maximum diameter DX) remains constant. The elastic roller diameter D1 is the intermediate diameter DD at the first side end part 245R, and is the minimum diameter DN at the second side end part 245L. In other words, an inner layer elastic material member 247 has two elongated tapered conical-shaped end parts of the platen roller 245 as sloping circumferential surfaces (the second side end part direction sloping circumferential surface 225, and the first side end part direction sloping circumferential surface 226). The coating layer 224 is coated from the first side end part 245R through the maximum diameter part 245M to the second side end part 245L, at the same coating thickness.

In the platen roller 245, by changing the starting position of the sloping circumferential surface starting part 225A for the second side end part direction sloping circumferential surface 225 and the sloping circumferential surface starting part 226A for the first side end part direction sloping circumferential surface 226, and by differing the slope angle or length between the second side end part direction sloping circumferential surface 225 and the first side end part direction sloping circumferential surface 226, a left-to-right asymmetrical shape may be achieved with respect to the center part 245C of the platen roller 245.

Accordingly, the platen roller 245 has a "modified asymmetrical cylinder shape." In other words, the platen roller 245 includes the first side end part direction sloping circumferential surface 226 that extends from the first side end part 245R to the maximum diameter part 245M, and includes the second side end part direction sloping circumferential surface 225 that extends from the sloping circumferential surface starting part 225A of the second side end part direction sloping circumferential surface 225 to the second side end part 245L along a predetermined length of the maximum diameter part 245M. Contact is made by the linerless label 1 and the maximum diameter part 245M that includes the center part 245C. Further, due to the size (width) of the linerless label 1, the thermal head 16 and the platen roller 245 are not strongly pressed together so as to make contact at an outer peripheral surface of the second side end part direction sloping circumferential surface 225 between the sloping circumferential surface starting part 225A and the second side end part 245L. Accordingly, unsatisfactory feeding or wear of the platen roller 245 may be prevented, and contact made by the linerless label 1 and the overall outer peripheral region may be reduced or avoided at the first side end part direction sloping circumferential surface 226 that extends between the sloping circumferential surface starting part 226A and the first side end part 245R.

Even in the platen roller 245 of the above configuration, the linerless label 1 or the label with a liner may be fed without hindrance, similarly to the platen roller 220 (see, FIGS. 1 and 2). Specifically, the platen roller 245 is configured such that a region (first side end part direction sloping circumferential surface 226) that extends from the first side end part 245R to the maximum diameter part 245M (sloping circumferential surface starting part 226A) avoids or reduces contact with the linerless label 1 or the label with a liner. However, a width F of the linerless label 1 or the label with a liner that is loaded must be at least two times a length from the first side end part 245R to the sloping circumferential surface starting part 226A, in order to ensure normal label feeding. On the other hand, contact between the thermal head 16 and the platen roller 245 is avoided or decreased at an outer peripheral surface of the second side end part direction sloping circumferential surface 225 that extends from the sloping circumferential surface starting part 225A to the second side end part 245L, and thus the thermal head 16 and the platen roller 245 are not strongly pressed together so as to make contact. Accordingly, unsatisfactory feeding or wear of the platen roller 245 may be prevented.

Figure 9:
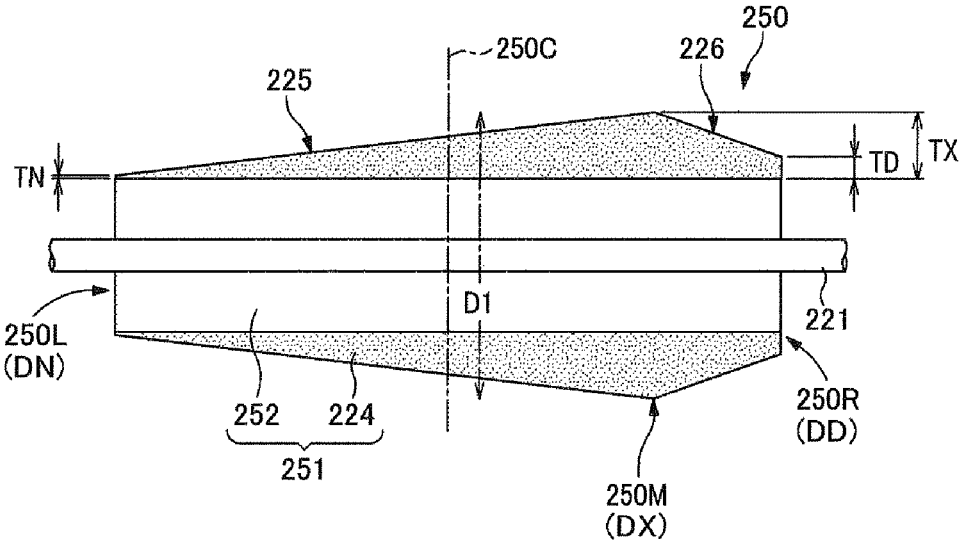
FIG. 9 shows a cross-sectional view of an axial direction of the elastic roller (a platen roller 250) according to an eighth embodiment of the present disclosure.

In the present disclosure, a coated or laminated structure for a coating layer 224 may be applied as appropriate. For example, the coating layer 224 may allow for a coating layer thickness of the inner surface perpendicular to the axial direction of the roller shaft 221 to have a maximum thickness between the center part of the elastic material member and the first side end part along an axial direction of the roller shaft 221. FIG. 9 is a cross-sectional view of an axial of the elastic roller (a platen roller 250) according to an eighth embodiment of the present disclosure. The platen roller 250, which is based on the platen roller 220 (see, FIG. 1) according to a first embodiment, includes the roller shaft 221 and the elastic material member 251. The elastic material member 251 includes a cylindrical inner layer elastic material member 252 disposed on an outer periphery of the roller shaft 221 and the coating layer 224 (outer layer side elastic material member) in direct contact with the linerless label 1 that is integrally disposed at an outer periphery of the inner layer elastic material member 252. The elastic roller diameter D1 of the platen roller 250 has a maximum diameter DX at the maximum diameter part 250M that is between the center part 250C of the elastic material member 251 and the first side end part 250R along the axial direction of the roller shaft 221. The inner layer elastic material member 252 is a cylindrical material member that is coaxial with the roller shaft 221.

On the other hand, from the cross-sectional shape of the coating layer 224, the coating layer 224 is coated so that a part extending from the second side end part 250L that opposes the first side end part 250R to the first side end part 250R on the inner layer elastic material member 252 has a minimum thickness TN; the first side end part 250R has an intermediate thickness TD; the maximum diameter part 250M has a maximum thickness TX; and the coating layer thickness is gradually reduced from the maximum diameter part 250M to the first side end part 250R and to the second side end part 250L.

Accordingly, the second side end part direction sloping circumferential surface 225 that extends between the maximum diameter part 250M and the second side end part 250L is formed, and the first side end part direction sloping circumferential surface 226 is formed between the maximum diameter part 250M and the first side end part 250R.

Even in the platen roller 250 of the above configuration, the linerless label 1 or the label with a liner may be fed without hindrance, similarly to the platen roller 220 (see, FIGS. 1 and 2). Specifically, productivity is high because the inner layer elastic material member 252 in the platen roller 250 has a simple cylindrical shape.

Figure 10:
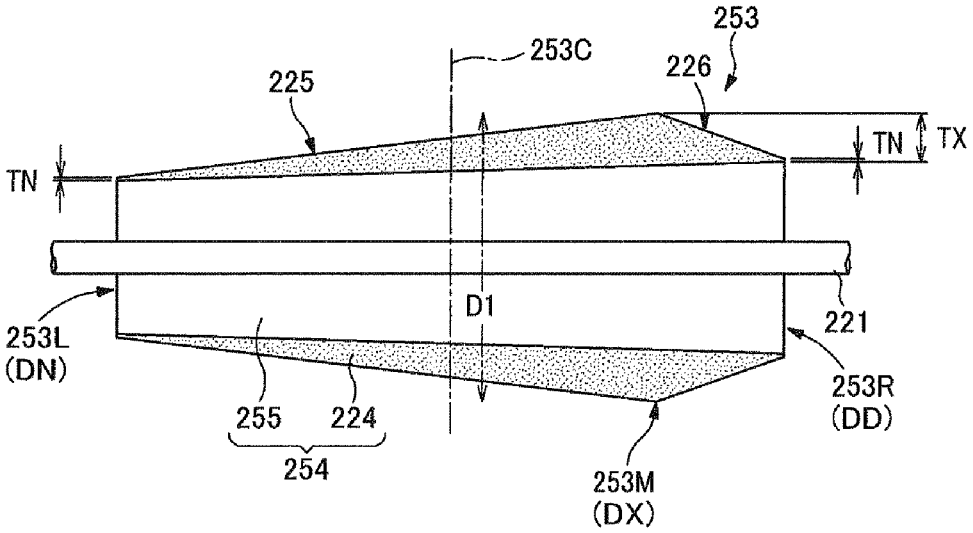
FIG. 10 shows a cross-sectional view of an axial direction of the elastic roller (a platen roller 253) according to a ninth embodiment of the present disclosure.

FIG. 10 is a cross-sectional view of an axial direction of the elastic roller (a platen roller 253) according to a ninth embodiment of the present disclosure. The platen roller 253 includes the roller shaft 221 and the elastic material member 254. The elastic material member 254 includes an inner layer elastic material member 255 disposed on an outer periphery of the roller shaft 221 and the coating layer 224 (outer layer side elastic material member) in direct contact with the linerless label 1 that is integrally disposed at an outer periphery of the inner layer elastic material member 255. The elastic roller diameter D1 of the platen roller 253 has a maximum diameter DX at the maximum diameter part 253M that is between the center part 253C of the elastic material member 254 and the first side end part 253R along the axial direction of the roller shaft 221. An outer contour of the inner layer elastic material member 255 has elongated tapered conical shape, and has a diameter that gradually increases from the second side end part 253L that opposes the first side end part 253R to the first side end part 253R.

On the other hand, from the cross-sectional shape of the coating layer 224, the coating layer 224 is coated so that the coating layer thickness of the coating layer 224 is a maximum thickness TX at the maximum diameter part 253M; the coating layer thickness is gradually decreased from the maximum diameter part 250M to the first side end part 253R and to the second side end part 253L; the coating layer thickness is a minimum thickness TN at the second side end part 253L in a part of the inner layer elastic material member 255 extending from the second side end part 253L to the first side end part 253R; and the coating layer thickness is also the minimum thickness TN at the first side end part 253R.

Accordingly, the second side end part direction sloping circumferential surface 225 is formed between the maximum diameter part 253M and the second side end part 253L, and the first side end part direction sloping circumferential surface 226 is formed between the maximum diameter part 253M and the first side end part 253R.

Even in the platen roller 253 of the above configuration, the linerless label 1 or the label with a liner may be fed without hindrance, similarly to the platen roller 220 (see, FIGS. 1 and 2). Specifically, a relatively simple configuration may be obtained for the platen roller 253 as a result of inner layer elastic material member 255 having an elongated tapered conical shape.

A coated or laminated structure for a coating layer 224 may be applied as appropriate with regard to the platen roller 230 (see, second embodiment; and FIG. 3), the platen roller 233 (see, third embodiment; and FIG. 4), the platen roller 236 (see, fourth embodiment; and FIG. 5), the platen roller 239 (see, fifth embodiment; and FIG. 6), the platen roller 242 (see, sixth embodiment; and FIG. 7), or the platen roller 245 (see, seventh embodiment; and FIG. 8) mentioned above.

Figure 11:
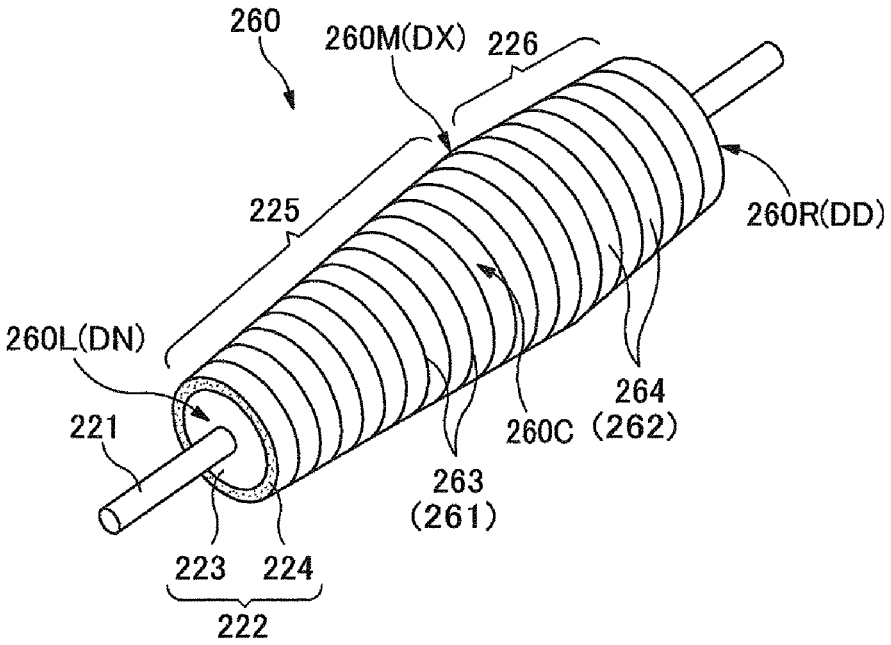
FIG. 11 shows a perspective view of the elastic roller (a platen roller 260) according to a tenth embodiment of the present disclosure.
Figure 12:
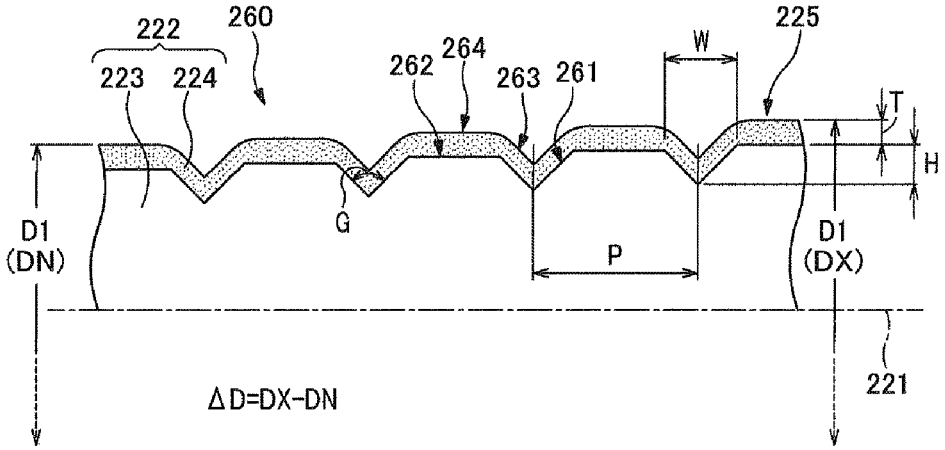
FIG. 12, similarly, shows enlarged cross-sectional view of an axial direction of a main part of the platen roller 260.

Next, an elastic roller (a platen roller 260) according to a tenth embodiment of the present disclosure will be described based on FIGS. 11 and 12. FIG. 11 shows a perspective view of the platen roller 260; and FIG. 12 shows an enlarged cross-sectional view of an axial direction of a main part of the platen roller 260. An elastic roller diameter D1 of the platen roller 260 has a maximum diameter DX at a maximum diameter part 260M that is between the center part 260C of the elastic material member 222 and the first side end part 260R along an axial direction of the roller shaft 221, similar to the abovementioned platen roller 220 (see, first embodiment; and FIG. 1). Further, the elastic roller diameter D1 of the platen roller 260 gradually decreases step-wise from the maximum diameter part 260M to the first side end part 260R and from the maximum diameter part 260M to the second side end part 260L that opposes the first side end part 260R, to form the first side end part direction sloping circumferential surface 226 and the second side end part direction sloping circumferential surface 225. As a result, the platen roller 260 has a so-called "grooved asymmetrical cylindrical shape."

In FIG. 12, a main part of a configuration for the elastic roller diameter D1 is shown gradually decreasing step-wise from a right-side to a left-side of the drawing. In addition, with respect to the platen roller 260 (elastic roller), a difference ΔD between the elastic roller maximum diameter DX at the maximum diameter part 260M and the minimum diameter DN at the second side end part 260L that opposes the first side end part 260R along an axial direction of the roller shaft 221 (ΔD=DX−DN) is 10 to 180 μm, similar to the abovementioned platen roller 220. The first side end part 260R has an intermediate diameter DD, which is the diameter between the maximum diameter DX and the minimum diameter DN.

Moreover, with respect to the platen roller 260, a plurality of cross-sectional (more precisely, cross-section intersecting by a plane that includes an axial line of the platen roller 220) V-shaped inner layer grooves 261 are formed along a circumferential direction of the inner layer elastic material member 223 in the platen roller 220 (see, first embodiment; and FIG. 1). The inner layer elastic material member 223 is configured with a flat inner layer platform-shaped apex part 262 between of the inner layer grooves 261.

The coating layer 224 is formed by a plurality of coating layer grooves 263 having a substantially V-shaped cross-section along the circumference of the coating layer 224, so as to conform to a surface of an upper layer side of the inner layer grooves 261.

In the coating layer 224, a flat coating layer platform-shaped apex portion 264 is formed between the coating layer grooves 263.

The coating layer 224 is formed by a plurality of coating layer grooves 263 having a substantially V-shaped cross-section along the circumference of the coating layer 224, so as to conform to a surface of an upper layer side of the inner layer grooves 261.

In the coating layer 224, a flat coating layer platform-shaped apex portion 264 is formed between the coating layer grooves 263.

The coating layer 224 has a substantially uniform coating layer thickness T in an axial direction of the roller shaft 221, and has the coating layer thickness T of 10 to 100 μm.

U-shape, a conical shape, or a multiangular shape such as a rectangular shape other than a V-shape may be applied as the cross-sectional shape of the inner layer grooves 261 and the coating layer grooves 263.

The inner layer grooves 261 have a pitch P of 500 to 1500 μm.

In a case where the pitch P of the inner layer grooves 261 is less than 500 μm, it is almost impossible to process such a small area of the inner layer platform-shaped apex portion 262, which is formed between the inner layer grooves 261 that are adjacent to each other.

In a case where the pitch P of the inner layer grooves 261 exceeds 1500 μm, there is decrease in a percentage of the inner layer grooves 261 and the coating layer grooves 263 with respect to the entire platen roller 260, there tends to be increase in a contact area between the platen roller 260 and a belt-shaped member such as the linerless label 1, and there tends to be decrease in release property of the platen roller 260.

The inner layer grooves 261 have a width W of 25 to 1300 μm, and more preferably a width W of 50 to 500 μm.

In a case where the inner layer grooves 261 have a width W of less than 25 μm, a contact area between the platen roller 260 and a belt-shaped member such as the linerless label 1 is increased. As a result, the release property of the platen roller 260 may be decreased.

In a case where the inner layer grooves 261 have a width W exceeding 1300 μm, the platen roller 260 decreases the pressing force of a part on the linerless label 1 or the like by the application of the appropriate pressure from the adhesive agent layer 3 side, such that printing precision may be decreased, e.g., printing omissions or the like with respect to a label piece 1A may occur with a printing part 12 of the thermal printer 8.

The inner layer grooves 261 have a depth H of 25 to 500 μm, and more preferably a depth H of 50 to 400 μm.

In a case where the inner layer grooves 261 have a depth H of less than 25 μm, a contact area between a belt-shaped member such as the linerless label 1 is increased. As a result, the release property of the platen roller 260 may be decreased.

In a case where the inner layer grooves 261 have a depth H exceeding 500 μm, the platen roller 260 decreases the pressing force of a part on the linerless label 1 or the like by the application of the appropriate pressure from the adhesive agent layer 3 side, such that printing precision may be decreased with respect to a label piece 1A in a printing part 12 of the thermal printer 8, e.g., printing omissions or the like may occur.

The inner layer grooves 261 have a groove angle G of 50 to 120 degrees, and more preferably a groove angle G of 60 to 100 degrees.

In a case where the inner layer grooves 261 have a groove angle G of less than 50 degrees, a contact area between the platen roller 260 and a belt-shaped member such as the linerless label 1 is increased. As a result, the release property of the platen roller 260 may be decreased.

In a case where the inner layer grooves 261 have a groove angle G exceeding 120 degrees, the platen roller 260 decreases the pressing force of a part on the linerless label 1 or the like by the application of the appropriate pressure from the adhesive agent layer 3 side, such that printing precision may be decreased, e.g., printing omissions or the like with respect to a label piece 1A may occur with a printing part 12 of the thermal printer 8.

A feeding test for the linerless label 1 and the label with a liner was performed using the platen roller 260 configured as described above, similar to the platen roller 220 (see, FIGS. 1 and 2) according to the first embodiment.

A coating layer 224 was formed from a thermosetting silicone resin (silicone gel) having a C hardness of 15 degrees at an outer periphery of the inner layer elastic material member 223, such that a coating layer thickness T thereof was 50 μm. In addition, the pitch P of the inner layer grooves 261 was configured to be 750 μm, the width W of the inner layer grooves 261 was configured to be 410 μm, the depth H of the inner layer grooves 261 was configured to be 350 μm, and the groove angle G of the inner layer grooves 261 was configured to be 60 degrees.

Moreover, a platen roller (comparative product) was prepared that has only the inner layer grooves 261 formed based on specifications identical to those mentioned above and that is lacking a coating layer 224. The linerless label 1 and label with a liner were fed to one side via the label single-side guide material member 227 (see, FIG. 2).

After the platen roller 260 according the present disclosure fed the linerless label 1 and the label with a liner for a distance of 20 km, the roll angle that was measured for the linerless label 1 was below 14 degrees and the roll angle that was measured for the label with a liner was below 9 degrees. Accordingly, it was understood that in both instances there was sufficient release property and a gripping force for the elastic roller.

On the other hand, even in a case where a roll angle measured for a platen roller formed only with the inner layer grooves 261 (without the coating layer 224) after feeding the linerless label 1 for a distance of 1 Km exceeded 70 degrees, the platen roller remained attached to the adhesive agent layer. Accordingly, it was found that the platen roller failed to include a release property that was sufficient for the intended application thereof. Moreover, in cases where a label with a liner was fed, slippage occurred continuously, feeding could not be sustained for a specified distance, and it was determined that sufficient function was lacking as a platen roller.

Accordingly, the platen roller 260 was obtained that included a necessary release property and gripping force for feeding a linerless label or a label with a liner by forming the inner layer grooves 261 on the inner layer elastic material member 223 and by forming the coating layer grooves 263 at the coating layer 224.

Next, another test for feeding the linerless label 1 was performed, similarly to that performed on the platen roller 220 according to the first embodiment (see, FIGS. 1 and 2), for the platen roller 233 according to the third embodiment shown in FIG. 4, using a platen roller (not shown) that includes inner layer grooves 261, an inner layer platform-shaped apex portion 262, the coating layer grooves 263, and a coating layer platform-shaped apex portion 264 (see, FIG. 12), which are similar to the platen roller 260 shown in FIG. 11.

A platen roller was prepared, in which an elastic material member 234 including the inner layer elastic material member 235 and the coating layer 224 has a width (length) of 120 mm, has a maximum diameter DX of 16.4 mm, has a minimum diameter DN of 16.3 mm and has a length from the first side end part 233R to the sloping circumferential surface starting part 225A of the second side end part direction sloping circumferential surface 225 of 16 mm (i.e., cylindrical shape having a 16.4 mm diameter from the first side end part 233R to the sloping circumferential surface starting part 225A); and has an elastic roller diameter D1 that gradually decreases by formation of the second side end part direction sloping circumferential surface 225 that is formed from the sloping circumferential surface starting part 225A to the second side end part 233L.

A coating layer 224 was formed from a thermosetting silicone resin (silicone gel) having a C hardness of 15 degrees, such that a coating layer thickness T at an outer periphery of the inner layer elastic material member 235 was 50 μm. In addition, the pitch P of the inner layer grooves 261 was configured to be 750 μm, the width W of the inner layer grooves 261 was configured to be 87 μm, the depth H of the inner layer grooves 261 was configured to be 75 μm, and the groove angle G of the inner layer grooves 261 was configured to be 60 degrees.

Moreover, the inner layer grooves 261 or the like as an elastic material member were formed so as to have a cylindrical shape with a width (length) of 120 mm and a diameter of 16.4 mm based on a size identical to that mentioned above, and a platen roller (comparative product) was prepared in which a coating layer 224 of an identical coating layer thickness T and C hardness was formed. Then, the linerless label 1 and label with a liner were fed to one side via the label single-side guide material member 227 (see, FIG. 2).

After the platen roller according to the present disclosure fed the linerless label 1 having a width of 100 mm for a distance of 30 km, the roll angle that was measured for the linerless label 1 was 13 degrees, and it was understood that there was sufficient release property and a gripping force for the elastic roller. Moreover, after the platen roller according to the present disclosure fed the linerless label 1 having a width of 50 mm for a distance of 30 km, the roll angle that was measured for the linerless label 1 was 13 degrees, and it was understood that there was sufficient release property and a gripping force for the elastic roller.

On the other hand, while a roll angle measured for a cylindrical platen roller as a comparative product after feeding the linerless label 1 having a width of 100 mm for a distance of 30 Km was 13 degrees, a roll angle measured for a platen roller after feeding the linerless label 1 having a width of 50 mm for a distance of 30 Km was 29 degrees. Accordingly, it was understood that a release property for the elastic roller was reduced.

Moreover, a wear level measured for a platen roller of the present disclosure after feeding the linerless label 1 having a width of 100 mm for a distance of 30 Km was 0.77%, and after feeding the linerless label 1 having a width of 50 mm for a distance of 30 Km was 0.94%. On the other hand, while a wear level measured for a cylindrical platen roller as a comparative product after a wear level measured for a platen roller of the present disclosure after feeding the linerless label 1 having a width of 100 mm for a distance of 30 Km was 0.77%, and after feeding the linerless label 1 having a width of 50 mm for a distance of 30 Km was 2.03%.

Accordingly, a configuration may be obtained that includes a release property and gripping force by formation of the platen roller 233 that forms the inner layer grooves 261 or the like at the inner layer elastic material member 234 and that forms the coating layer grooves 263 or the like at the coating layer 224.

In addition, even in a case of printing and feeding as either a linerless label 1B having a narrow width or a linerless labels 1C, 1D having a broad width that is loadable in the thermal printer 8 (see, FIG. 14) similar to that described based on FIG. 2, the second side end part 260L of the platen roller 260 has a diameter in comparison to the maximum diameter part 260M thereof reduced by $\Delta D = DX - DN$, such that there is no contact or light contact between the thermal head 16 and the platen roller 260 at end parts of the linerless labels 1B, 1C, and that the printing and feeding thereof is not impeded.

In the present disclosure, in a case of the platen roller 220 (see, first embodiment; and FIG. 1), the platen roller 230 (see, second embodiment; and FIG. 3), the platen roller 233 (see, third embodiment; and FIG. 4), the platen roller 236 (see, fourth embodiment; and FIG. 5), the platen roller 239 (see, fifth embodiment; and FIG. 6), the platen roller 242 (see, sixth embodiment; and FIG. 7), the platen roller 245 (see, seventh embodiment; and FIG. 8), the platen roller 250 (see, eighth embodiment; and FIG. 9), the platen roller 253 (see, ninth embodiment; and FIG. 10), or the platen roller 260 (see, tenth embodiment; and FIG. 11), the linerless label 1 (see, FIG. 13), the linerless label 1B having a narrow width and the linerless labels 1C, 1D having a broad width (see, FIG. 2) may be stably fed even to the label with a liner by employing a configuration forming a partially flat region across any surface area of the maximum diameter part 220M, 230M, 233M, 236M, 239M, 242M, 245M, 250M, 253M, 260M in the axial direction of the roller shaft 221 (e.g., see, platen roller 242 according to a sixth embodiment shown in FIG. 7 and a platen roller 245 according to a seventh embodiment shown in FIG. 8).

Further, in the present disclosure, in a case of the platen roller 230 (see, second embodiment; and FIG. 3), the platen roller 233 (see, third embodiment; and FIG. 4), the platen roller 236 (see, fourth embodiment; and FIG. 5), the platen roller 239 (see, fifth embodiment; and FIG. 6), the platen roller 242 (see, sixth embodiment; and FIG. 7), the platen roller 245 (see, seventh embodiment; and FIG. 8), the platen roller 250 (see, eighth embodiment; and FIG. 9), or the platen roller 253 (see, ninth embodiment; and FIG. 10), an elastic roller may be obtained that has a groove and a platform-shaped apex portion, similar to that of the platen roller 260 (see, tenth embodiment; and FIG. 11), by forming grooves and a platform-shaped apex portion that abut inner layer grooves 261, an inner layer platform-shaped apex portion 262, coating layer grooves 263, a coating layer platform-shaped apex portion 264, or the like, to obtain a so-called "grooved modified asymmetrical cylindrically-shaped" configuration. Accordingly, an elastic roller may be realized that has a reliable and stable feeding function and a guidance function.

DESCRIPTION OF REFERENCE NUMERALS

1 a linerless label (see, FIG. 13);
1A a label piece of a linerless label 1;
1B a linerless label having a narrow width (see, FIG. 2);
1C, 1D a linerless label having a broad width (see, FIG. 2);
2 a label substrate;
3 an adhesive agent layer;
4 a thermosensitive color developing agent layer;
5 a release agent layer;
6 a position detection mark;
7 an intended cutting line;
8 a thermal printer (see, FIG. 14);
9 a supplier;
10 a guide member;
11 a detector;
12 a printing portion;
13 a cutter;
14 a guide roller;
15 a location detection sensor;
16 a thermal head;
17 a platen roller;
18 a fixed blade;
19 a movable blade;
220 a platen roller (elastic roller, first embodiment, FIG. 1);

220C a center part of an elastic material member 222 on the platen roller 220;
220R a first side end part of the platen roller 220;
220L a second side end part opposite to the first side end part 220R of the platen roller
220;
220M a maximum diameter part of the platen roller 220;
221 a roller shaft;
222 an elastic material member;
223 an inner layer elastic material member;
223M a maximum diameter part of the inner layer elastic material member 223;
223R a first side end part of the inner layer elastic material member 223;
223L a second side end part opposite to the first side end part 220R of the inner layer elastic material member 223;
224 a coating layer;
225 a second side end part direction sloping circumferential surface;
225A a sloping circumferential surface starting part of the second side end part direction sloping circumferential surface (maximum diameter part 223M; see, FIG. 2);
225B a sloping circumferential surface ending part of the second side end part direction sloping circumferential surface 225 (see, FIG. 5);
226 a first side end part direction sloping circumferential surface;
226A a sloping circumferential surface starting part of the first side end part direction sloping circumferential surface 226;
227 a label single-side guide material member (see, FIG. 2);
228 a maximum diameter location mark (see, FIGS. 1 and 2);
230 a platen roller (elastic roller, second embodiment, FIG. 3);
230C a center part of an elastic material member 231 on the platen roller 230;
230R a first side end part of the platen roller 230;
230L a second side end part opposite to the first side end part 230R of the platen roller 230;
230M a maximum diameter part of the platen roller 230;
231 an elastic material member;
232 an inner layer elastic material member;
233 a platen roller (elastic roller, third embodiment, FIG. 4);
233C a center part of an elastic material member 234 on the platen roller 233;
233R a first side end part of the platen roller 233;
233L a second side end part opposite to the first side end part 233R of the platen roller 233;
233M a maximum diameter part of the platen roller 233;
234 an elastic material member;
235 an inner layer elastic material member;
236 a platen roller (elastic roller, fourth embodiment, FIG. 5);
236C a center part of an elastic material member 237 on the platen roller 236;
236R a first side end part of the platen roller 230;
236L a second side end part opposite to the first side end part 236R of the platen roller 236;
236M a maximum diameter part of the platen roller 236;
237 an elastic material member;
238 an inner layer elastic material member;
239 a platen roller (elastic roller, fifth embodiment, FIG. 6);
239C a center part of an elastic material member 240 on the platen roller 239;
239R a first side end part of the platen roller 239;
239L a second side end part opposite to the first side end part 239R of the platen roller 239;
239M a maximum diameter part of the platen roller 239;
240 an elastic material member;
241 an inner layer elastic material member;
242 a platen roller (elastic roller, sixth embodiment, FIG. 7);
242C a center part of an elastic material member 243 on the platen roller 242;
242R a first side end part of the platen roller 242;
242L a second side end part opposite to the first side end part 242R of the platen roller 242;
242M a maximum diameter part of the platen roller 242;
243 an elastic material member;
244 an inner layer elastic material member;
245 a platen roller (elastic roller, seventh embodiment, FIG. 8);
245C a center part of an elastic material member 246 on the platen roller 245;
245R a first side end part of the platen roller 245;
245L a second side end part opposite to the first side end part 245R of the platen roller 245;
245M a maximum diameter part of the platen roller 245;
246 an elastic material member;
247 an inner layer elastic material member;
250 a platen roller (elastic roller, eighth embodiment, FIG. 9);
250C a center part of an elastic material member 251 on the platen roller 250;
250R a first side end part of the platen roller 250;
250L a second side end part opposite to the first side end part 250R of the platen roller 250;
250M a maximum diameter part of the platen roller 250;
251 an elastic material member;
252 an inner layer elastic material member;
253 a platen roller (elastic roller, ninth embodiment, FIG. 10);
253C a center part of an elastic material member 254 on the platen roller 253;
253R a first side end part of the platen roller 253;
253L a second side end part opposite to the first side end part 253R of the platen roller 253;
253M a maximum diameter part of the platen roller 253;
254 an elastic material member;
255 an inner layer elastic material member;
260 a platen roller (elastic roller, tenth embodiment, FIG. 11);
260C a center part of an elastic material member 222 forming the platen roller 260;
260R a first side end part of the platen roller 260;
260L a second side end part opposite to the first side end part 260R of the platen roller 260;
260M a maximum diameter part of the platen roller 260;
261 inner layer grooves;
262 an inner layer platform-shaped apex portion;
263 coating layer grooves;
264 a coating layer platform-shaped apex portion;
F a minimum width of the linerless label 1 (see, FIG. 2);
T a coating thickness of the coating layer 224 (see, FIGS. 2 and 12);
TX a maximum thickness of the coating layer 224 (see, FIGS. 9 and 10);
TD an intermediate thickness of the coating layer 224 (see, FIG. 9);
TN a minimum thickness of the coating layer 224 (see, FIGS. 9 and 10);
DX a maximum diameter of a diameter D1 of the elastic roller (see, FIGS. 2 to 12);

DD a intermediate diameter of a diameter D1 of the elastic roller (see, FIGS. 8, 9, and 10);

DN a minimum diameter of a diameter D1 of the elastic roller (see, FIGS. 2 to 12);

D1 an elastic roller diameter of the platen roller 220, 230, 233, 236, 239, 242, 245, 250, 253 and 260 (see, FIGS. 2 and 12);

D2 an inner layer elastic material member diameter of the inner layer elastic material member 223 (see, FIG. 2); and ΔD a difference between the maximum diameter DX and the minimum diameter DN (ΔD=DX−DN; see, FIGS. 2 and 12), with regard to the elastic roller diameter D1;

P Pitch of the inner layer grooves 261 (see, FIG. 12);

W Width of the inner layer grooves 261 (see, FIG. 12);

H Depth of the inner layer grooves 261 (see, FIG. 12); and

G Groove angle of the inner layer grooves 261 (see, FIG. 12).

The invention claimed is:

1. An elastic roller for feeding a belt-shaped member, the elastic roller comprising:

a roller shaft; and an elastic material member surrounding the roller shaft, the elastic material member configured to feed the belt-shaped member by making contact with the belt-shaped member, the elastic material member including:

an inner layer elastic material member disposed on an outer periphery of the roller shaft, a coating layer disposed on an outer periphery of the inner layer elastic material member, the coating layer configured to make contact with the belt-shaped member, and the coating layer being formed from a silicone resin having a hardness of 20 degrees or less based on a spring type hardness tester Asker C in accordance with SRIS 0101, a first side end part circumferential surface having a first side end part, and a second side end part circumferential surface having a second side end part, the second side end part circumferential surface having an elastic roller diameter that gradually decreases towards the second side end part opposite to the first side end part in an axial direction of the roller shaft.

2. The elastic roller according to claim 1, wherein the second side end part circumferential surface is formed such that a left-to-right shape of the elastic roller is asymmetrical with respect to a center part of the elastic material member in the axial direction of the roller shaft.

3. The elastic roller according to claim 1, wherein the second side end part circumferential surface is formed such that a sloping circumferential surface starting part is a region in the axial direction of the elastic material member.

4. The elastic roller according to claim 1, wherein the first side end part circumferential surface has the elastic roller diameter that gradually decreases towards the first side end part direction in the axial direction of the roller shaft.

5. The elastic roller according to claim 1, wherein the elastic roller diameter of the elastic roller has a maximum diameter in a maximum diameter part between the center part of the elastic material member and the first side end part in the axial direction of the roller shaft.

6. The elastic roller according to claims, wherein the elastic roller diameter of the elastic roller continuously and gradually decreases from the maximum diameter part to the first side end part in the axial direction of the roller shaft.

7. The elastic roller according to claim 6, wherein the elastic roller diameter of the elastic roller decreases stepwise from the maximum diameter part to the second side end part in the axial direction of the roller shaft.

8. The elastic roller according to claim 5, wherein the elastic roller diameter of the elastic roller continuously and gradually decreases from the maximum diameter part to the second side end part in the axial direction of the roller shaft.

9. The elastic roller according to claim 8, wherein the elastic roller diameter of the elastic roller decreases stepwise from the maximum diameter part to the first side end part in the axial direction of the roller shaft.

10. The elastic roller according to claim 5, wherein the elastic roller diameter of the elastic roller is identical to the maximum diameter from the maximum diameter part to the first side end part in the axial direction of the roller shaft.

11. The elastic roller according to claim 10, wherein the elastic roller diameter of the elastic roller decreases stepwise from the maximum diameter part to the second side end part in the axial direction of the roller shaft.

12. The elastic roller according to claim 5, wherein the elastic roller diameter of the elastic roller decreases stepwise from the maximum diameter part to the first side end part in the axial direction of the roller shaft.

13. The elastic roller according to claim 12, wherein the elastic roller diameter of the elastic roller decreases stepwise from the maximum diameter part to the second side end part in the axial direction of the roller shaft.

14. The elastic roller according to claim 5, wherein the elastic roller diameter of the elastic roller decreases stepwise from the maximum diameter part to the second side end part in the axial direction of the roller shaft.

15. The elastic roller according to claim 5, wherein the coating layer has a maximum thickness at the maximum diameter part.

16. The elastic roller according to claim 5, wherein a difference in the elastic roller diameter of the elastic roller between the maximum diameter and a minimum diameter on the second side end part is 10 to 180 μm.

17. The elastic roller according to claim 5, wherein a maximum diameter location mark for indicating the maximum diameter part is disposed on the elastic material member.

18. The elastic roller according to claim 5, wherein an area of the maximum diameter part is partially flat.

19. The elastic roller according to claim 1, wherein the elastic roller diameter of the elastic roller has a minimum diameter on the second side end part in the axial direction of the roller shaft.

20. The elastic roller according to claim 1, wherein the coating layer has a thickness of 10 to 100 μm.

21. The elastic roller according to claim 1, wherein the coating layer has a uniform coating thickness in a plane perpendicular to the axial direction of the roller shaft.

22. The elastic roller according to claim 1, wherein the silicone resin has a thermosetting property.

23. The elastic roller according to claim 1, wherein the inner layer elastic material member is formed from a thermoplastic material or a thermosetting elastomeric material.

24. The elastic roller according to claim 1, wherein the inner layer elastic material member has a rubber hardness of 30 to 80 degrees according to a Durometer Hardness Testing Method Type A defined in JIS K6253.

25. The elastic roller according to claim 1, wherein the inner layer elastic material member is configured with a plurality of inner layer grooves in a circumferential direction thereof.

26. The elastic roller according to claim 25, wherein the inner layer elastic material member is configured with a flat inner layer platform-shaped apex portion between the plurality of inner layer grooves.

27. The elastic roller according to claim 25, wherein the plurality of inner layer grooves have a pitch of 500 to 1500 μm.

28. The elastic roller according to claim 25, wherein the plurality of inner layer grooves have a width of 25 to 1300 μm.

29. The elastic roller according to claim 25, wherein the plurality of inner layer grooves have a depth of 25 to 500 μm.

30. The elastic roller according to claim 26, wherein the plurality of inner layer grooves have a V-shaped cross-section and a groove angle of 50 to 120 degrees.

31. The elastic roller according to claim 1, wherein the coating layer is configured with a plurality of coating layer grooves in a circumferential direction thereof.

32. The elastic roller according to claim 31, wherein the coating layer is configured with a flat coating layer platform-shaped apex portion between the plurality of coating layer grooves.

33. An elastic roller for feeding a belt-shaped member, the elastic roller comprising:

a roller shaft; and an elastic material member surrounding the roller shaft, the elastic material member configured to feed the belt-shaped member by making contact with the belt-shaped member, the elastic material member including:

an inner layer elastic material member disposed on an outer periphery of the roller shaft;

a coating layer disposed on an outer periphery of the inner layer elastic material member, the coating layer configured to make contact with the belt-shaped member, and the coating layer being formed from a silicone resin having a hardness of 20 degrees or less based on a spring type hardness tester Asker C in accordance with SRIS 0101;

a first side end part;

a second side end part opposite to the first side end part in an axial direction of the roller shaft; and a circumferential surface having an elastic roller diameter that gradually decreases from the first side end part to the second side end part.

* * * * *